US010839755B2

(12) United States Patent
Ha et al.

(10) Patent No.: US 10,839,755 B2
(45) Date of Patent: Nov. 17, 2020

(54) DISPLAY DEVICE CAPABLE OF CHANGING LUMINANCE DEPENDING ON OPERATING FREQUENCY

(71) Applicant: SAMSUNG DISPLAY CO., LTD., Yongin-si (KR)

(72) Inventors: Tae-seok Ha, Hwaseong-si (KR); Kyung-hun Lee, Yongin-si (KR); Sucheol Kang, Yongin-si (KR); Jongwoon Kim, Cheonan-si (KR); Kyu-jin Park, Cheonan-si (KR); Sung-jae Park, Seongnam-si (KR); Seung-woon Shin, Asan-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 114 days.

(21) Appl. No.: 16/117,885

(22) Filed: Aug. 30, 2018

(65) Prior Publication Data

US 2019/0180695 A1 Jun. 13, 2019

(30) Foreign Application Priority Data

Dec. 11, 2017 (KR) ..... 10-2017-0169658

(51) Int. Cl.
*G09G 5/10* (2006.01)
*G09G 3/3291* (2016.01)
(Continued)

(52) U.S. Cl.
CPC ..... *G09G 3/3291* (2013.01); *G09G 3/2051* (2013.01); *G09G 3/3266* (2013.01);
(Continued)

(58) Field of Classification Search
CPC ... G09G 2320/0276; G09G 2320/0285; G09G 2320/064; G09G 2320/0673;
(Continued)

(56) References Cited

U.S. PATENT DOCUMENTS 9,501,993 B2 11/2016 Nambi et al.
9,818,364 B2 11/2017 Lee et al.
(Continued)

FOREIGN PATENT DOCUMENTS

KR 1020140057462 5/2014
KR 1020160025675 3/2016
(Continued)

*Primary Examiner* — Insa Sadio
(74) *Attorney, Agent, or Firm* — F. Chau & Associates, LLC

(57) ABSTRACT

A display device includes a display panel including gate lines, data lines, and pixels individually connected to a corresponding gate line and data line, a gate driver driving the gate lines, a data driver driving the data lines, and a driving controller. The driving controller receives, from an external source, first image signals and a variable frequency signal indicating an operation frequency (frame rate) for the display device. The driving controller converts the first image signals to second image signals by adding a compensation value corresponding to the operation frequency to the first image signals, and outputs the second image signals to the data driver. Embodiments may compensate for luminance reduction/variation and reduce image artifacts that otherwise occur due to variable frequency operation. An alternative embodiment dynamically controls an amount of light output from a backlight according to the variable frequency signal.

20 Claims, 16 Drawing Sheets

(51) Int. Cl.

| | |
|---|---|
| ***G09G 3/3266*** | (2016.01) |
| ***G09G 3/36*** | (2006.01) |
| ***G09G 3/20*** | (2006.01) |
| *G09G 3/34* | (2006.01) |

(52) U.S. Cl.
CPC ..... *G09G 3/3677* (2013.01); *G09G 3/3688* (2013.01); *G09G 3/3406* (2013.01); *G09G 2320/0276* (2013.01); *G09G 2320/0285* (2013.01); *G09G 2320/064* (2013.01); *G09G 2320/0673* (2013.01); *G09G 2340/0435* (2013.01); *G09G 2340/16* (2013.01)

(58) Field of Classification Search
CPC ..... G09G 2340/0435; G09G 2340/16; G09G 3/2051; G09G 3/3266; G09G 3/3291; G09G 3/3406; G09G 3/3677; G09G 3/3688
See application file for complete search history.

(56) References Cited

U.S. PATENT DOCUMENTS

| | | | | |
|---|---|---|---|---|
| 2010/0020112 | A1* | 1/2010 | Jeon | G09G 3/3648 345/690 |
| 2013/0050273 | A1* | 2/2013 | Fujimura | H04N 21/4122 345/668 |
| 2014/0128131 | A1 | 5/2014 | Sin | |
| 2017/0124962 | A1 | 5/2017 | Oh et al. | |
| 2017/0236487 | A1 | 8/2017 | Guo et al. | |

FOREIGN PATENT DOCUMENTS

| | | |
|---|---|---|
| KR | 10-1651291 | 8/2016 |
| KR | 1020170051795 | 5/2017 |
| KR | 10-1761400 | 7/2017 |
| KR | 10-1774127 | 8/2017 |

* cited by examiner

DISPLAY DEVICE CAPABLE OF CHANGING LUMINANCE DEPENDING ON OPERATING FREQUENCY

CROSS REFERENCE TO RELATED APPLICATION(S)

This U.S. non-provisional patent application claims priority under 35 U.S.C. § 119 of Korean Patent Application No. 10-2017-0169658, filed on Dec. 11, 2017, the contents of which are hereby incorporated by reference in its entirety.

BACKGROUND

1. Technical Field

The present disclosure relates generally to a display device and more particularly, to a display device capable of changing an operating frequency thereof.

2. Discussion of the Related Art

A display device includes gate lines, data lines, and pixels connected to the gate lines and the data lines. The display device includes a gate driver to apply gate signals to the gate lines and a data driver to synchronously apply data signals to the data lines.

A display device may be designed to operate at a variable frame rate to support various applications. For instance, in real time rendering a variable frame rate may allow for a variation in rendering time from frame to frame depending on image complexity and an amount of motion. In other examples, a frame rate may be reduced relative to a standard frame rate to conserve power when displaying video of a relatively slow moving scene. In the case of rendering, it may be time consuming and processor intensive to render a high-definition game image or a virtual reality game image using a graphic processor.

In variable frame rate systems, operation at a lower frame rate may reduce luminance of the image due to capacitive discharge within the display pixels. When switching between high and low frame rates, the change in luminance may be noticeable to a user and thereby degrade image quality. In the case of rendering, if rendering time for an image signal of one frame becomes longer than a frame frequency of the display device, image quality of the displayed image may deteriorate.

SUMMARY

The present disclosure provides a display device capable of improving the quality of a display image.

In an illustrative embodiment, a display device includes a display panel including gate lines, data lines, pixels individually connected to a corresponding gate line and data line, a gate driver driving the gate lines, a data driver driving the data lines, and a driving controller. The driving controller receives, from an external source, first image signals and a variable frequency signal indicating an operation frequency (1/frame length) for one or more frames to be displayed by the display device. The driving controller converts the first image signals to second image signals by adding a compensation value corresponding to the operation frequency to the first image signals, and outputs the second image signals to the data driver.

In Various Embodiments

When the operation frequency indicated by the variable frequency signal is lower than a reference frequency, the compensation value may have a first value, and when the operation frequency indicated by the variable frequency signal is equal to or greater than the reference frequency, the compensation value may have a second value different from the first value.

The driving controller may include an image signal processing circuit configured to convert the first image signals to the second image signals.

The image signal processing circuit may include a dithering circuit configured to dither the first image signals based on the compensation value in response to the variable frequency signal, and to output the second image signals.

The dithering circuit includes a plurality of dithering maps each having a size of "a" by "b" (each of the "a" and "b" is a positive integer), dithers the first image signals using the dithering maps, and outputs the first image signals.

The image signal processing circuit includes a plurality of lookup tables storing different compensation values from each other and a gamma correction circuit converting the first image signals to the second image signals with reference to a lookup table corresponding to the variable frequency signal among the lookup tables.

The image signal processing circuit includes a plurality of lookup tables storing different dithering maps from each other and a dithering circuit dithering the first image signals with reference to a lookup table corresponding to the variable frequency signal among the lookup tables to output the second image signals.

The image signal processing circuit includes a compensation value calculator calculating a first compensation value corresponding to the variable frequency signal, a buffer delaying the first compensation value for one frame to output a second compensation value, and an adder adding the second compensation value corresponding to a previous frame to the first image signals of a present frame to output the second image signals, and the compensation value is the second compensation value.

The second compensation value has a first value when the variable frequency signal corresponding to the previous frame indicates a first frequency range, and the second compensation value has a second value different from the first value when the variable frequency signal corresponding to the previous frame indicates a second frequency range higher than the first reference range.

The first value is smaller than the second value, and the first value is a negative number.

The display device further includes a voltage generator that generates first and second driving voltages, and the driving controller further outputs a voltage control signal in response to the variable frequency signal to change a voltage level of the first and second driving voltages.

The driving controller includes a control signal generator generating a first control signal to control the data driver and a second control signal to control the gate driver and a voltage controller generating the voltage control signal in response to the variable frequency signal.

The voltage controller generates the voltage control signal to increase the voltage level of the first driving voltage to a predetermined level when the operation frequency indicated by the variable frequency signal is lower than a reference frequency.

The control signal generating circuit generates the voltage control signal to allow the first driving voltage to have a first level when the operation frequency indicated by the variable frequency signal is equal to or greater than a reference frequency, and the control signal generating circuit generates the voltage control signal to allow the first driving voltage to have a second level higher than the first level when the operation frequency indicated by the variable frequency signal is equal to or lower than a reference frequency.

The data driver includes a resistor string generating a plurality of gamma voltages between the first driving voltage and the second driving voltage, a lookup table outputting one gamma selection signal among a plurality of gamma selection signals in response to a reference gamma selection signal, a first decoder selecting some gamma voltages of the gamma voltages in response to the gamma selection signal output from the lookup table and outputting the selected gamma voltages as plural gamma reference voltages, and a second decoder converting the second image signals to grayscale voltages with reference to the gamma reference voltages, and the grayscale voltages are applied to the data lines.

The driving controller outputs the reference gamma selection signal corresponding to the variable frequency signal.

The variable frequency signal is included in a dummy data section of the first age signals and applied to the driving controller.

The driving controller includes a memory storing the first image signals and outputting previous frame image signals, a frequency sensor outputting a frequency sensing signal based on the variable frequency signal included in the first image signal, and an image signal processing circuit outputting the second image signals obtained by adding a compensation value corresponding to the frequency sensing signal to the previous frame image signals.

Another embodiment of the inventive concept provides a display device including a display panel including a plurality of gate lines, a plurality of data lines, and a plurality of pixels each being connected to a corresponding gate line among the gate lines and a corresponding data line among the data lines, a gate driver driving the gate lines, a data driver driving the data lines, a backlight unit providing a light to the display panel in response to a backlight control signal, and a driving controller configured to output second image signals to the data driver derived from first image signals received thereby, control the gate driver, and output the backlight control signal to control a luminance level of the light output by the backlight unit as a function of an operation frequency indicated by a variable frequency signal received from an external source.

The driving controller outputs the backlight control signal to control the backlight unit to provide the light having a first luminance when an operation frequency indicated by the variable frequency signal is higher than a reference frequency, and the driving controller outputs the backlight control signal to control the backlight unit to provide the light having a second luminance higher than the first luminance when the operation frequency indicated by the variable frequency signal is lower than a reference frequency.

According to the above, when the operating frequency is changed, the display device changes the luminance of the image displayed through the display panel depending on the changed operating frequency. Particularly, in the case that the blank period becomes longer due to the operating frequency that is lower than the reference frequency, the display device increases the luminance of the image signal, which is to be displayed through the display panel, the display quality may be prevented from deteriorating.

BRIEF DESCRIPTION OF THE DRAWINGS

The above and other aspects of the present disclosure will become readily apparent by reference to the following detailed description when considered in conjunction with the accompanying drawings, in which like reference numerals refer to like elements or features, wherein.

DETAILED DESCRIPTION

Hereinafter, embodiments of the inventive concept will be explained in detail with reference to the accompanying drawings.

Figure 1:
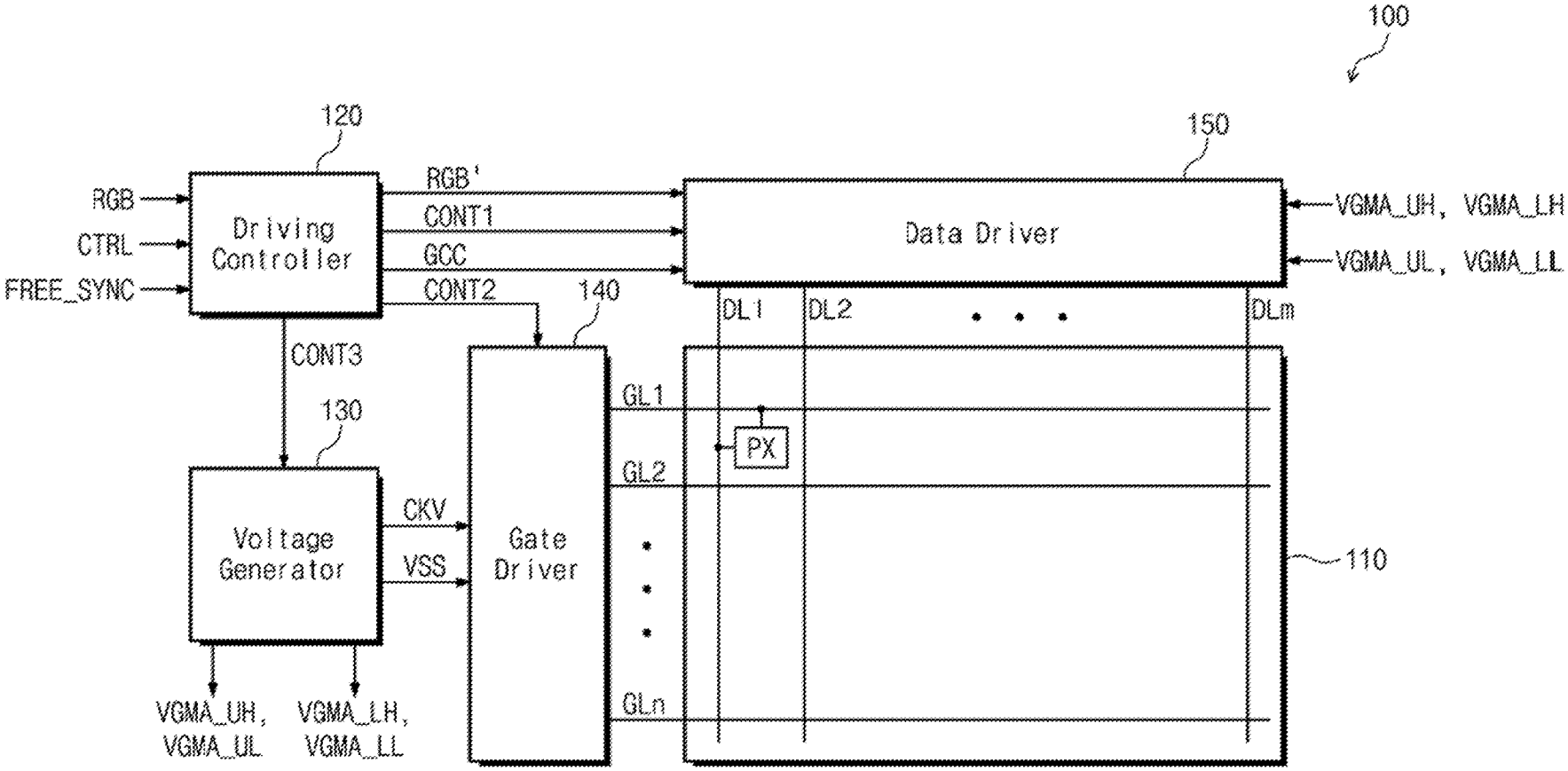
FIG. 1 is a block diagram showing a configuration of a display device according to an exemplary embodiment of the present disclosure.

FIG. 1 is a block diagram showing a configuration of a display device 100 according to an exemplary embodiment of the present disclosure. Display device 100 includes a display panel 110, a driving controller 120, a voltage generator 130, a gate driver 140, and a data driver 150.

The display panel 110 includes a plurality of data lines DL1 to DLm, a plurality of gate lines GL1 to GLn arranged to cross the data lines DL1 to DLm, and a plurality of pixels PX arranged in areas at which the data lines DL1 to DLm cross the gate lines GL1 to GLn. The data lines DL1 to DLm are insulated from the gate lines GL1 to GLn.

Display device 100 may be a liquid crystal display (LCD) device. In this case, although not shown in figures, each pixel PX may include a switching transistor connected to a corresponding data line among the data lines DL1 to DLm and a corresponding gate line among the gate lines GL1 to GLn, a liquid crystal capacitor connected to the switching transistor, and a storage capacitor connected to the switching transistor.

Display device 100 may alternatively be an organic light emitting display (©LED) device, and in this case each pixel PX may include an organic light emitting diode and switching transistors used to drive the organic light emitting diode.

Display device 100 is capable of operating at a variable frame rate, i.e., a variable operating frequency. Herein, the term "operation frequency", when referring to individual frames of a frame sequence, does not imply that a particular frame of a frame length FL=1/(operation frequency) is to be repetitively supplied at a constant frequency. Rather, the term is used to signify that when a frame has a frame length of FL, if plural frames of the same length FL were to be supplied consecutively, the operation frequency would be 1/FL.

Briefly, driving controller 120 receives a variable frequency signal FREE_SYNC, for setting a current operating frequency, from an external source such as a GPU. Driving controller 120 also receives first image signals RGB representing a frame(s) of video. When the operating frequency is low, the frame length of the frame is relatively long, and in a conventional display device this causes overall luminance of the image to decrease due to capacitive discharge in the pixels. The decrease in luminance degrades image quality by producing flicker or the like, e.g., when a video sequence includes low operation frequency frames interspersed with high operation frequency frames.

In accordance with one aspect of the inventive concept, driving controller 120 converts the first image signals RGB to second image signals RGB', which are output to data driver 150. The conversion is made by increasing grayscale values of the first image signals RGB by a compensation amount(s) based on the current operating frequency indicated by the FREE_SYNC signal. For at least the low operating frequencies, the conversion results in the second image signals RGB' having higher grayscale values than the first image signals RGB, which increases luminance of the image and compensates for the luminance drop-off caused by the longer frame length. For higher operating frequencies, the compensation amount is less (or no compensation is made), whereby the second image signals RGB' more closely resemble the first image signals RGB. Consequently, as the frame rate changes from a low rate to a high rate and vice versa, the significant change in luminance that would otherwise be noticeable by a viewer as flicker or the like, is reduced or eliminated.

Additional or alternative compensation for the luminance drop-off may be made by varying driving voltages output by voltage generator 130 as a function of the FREE_SYNC signal. This approach will be discussed in detail with reference to FIGS. 15-18.

Accordingly, the driving controller 120 receives, from an external source (not shown), first image signals RGB and control signals CTRL, e.g., a vertical synchronization signal, a horizontal synchronization signal, a main clock signal, a data enable signal, etc., to control the display of video represented by the first image signals RGB. The driving controller 120 generates and applies the second image signals RGB', which are obtained by processing the first image signals RGB by taking into account an operating condition of the display panel 100 based on the control signals CTRL and a first control signal CONT1, to the data driver 150 and applies a second control signal CONT2 to the gate driver 140. The first control signal CONT1 includes a clock signal CLK, a polarity inversion signal POL (see FIG. 17), and a line latch signal LOAD. The second control signal CONT2 includes a vertical synchronization start signal, an output enable signal, and a gate pulse signal.

For producing a video based on rendering, for example, a graphic processor (not shown) providing the first image signals RGB may take a long time relative to a typical frame length to render a high-definition game image and a virtual reality image. When an operation frequency of the display device 100 is changed depending on a rendering time for the first image signals RGB of one frame, the graphic processor may secure the sufficient rendering time, and the display device 100 may improve a display image quality. The display device 100 receives the variable frequency signal FREE_SYNC, which indicates information about the operating frequency, from the external graphic processor. In addition, the driving controller 120 outputs the second image signals RGB' obtained by adding a compensation value corresponding to the operating frequency indicated by the variable frequency signal FREE_SYNC to the first image signals RGB.

The voltage generator 130 generates a plurality of voltages and clock signals, which are used for the operation of the display panel 110. In the present exemplary embodiment, the voltage generator 130 applies a gate clock signal CKV and a ground voltage VSS to the gate driver 140. Voltage generator 130 further generates a first driving voltage VGMA_UH, a second driving voltage VGMA_UL, a third driving voltage VGMA_LH, and a fourth driving voltage VGMA_LL, which are used for the operation of the data driver 150.

The voltage generator 130 sets a voltage level of the first driving voltage VGMA_UH, the second driving voltage VGMA_LL, the third driving voltage VGMA_LH, and the fourth driving voltage VGMA_LL in response to a voltage control signal CONT3 from the driving controller 130.

The gate driver 140 drives the gate lines GL1 to GLn in response to the second control signal CONT2 from the driving controller 120, the gate clock signal CKV from the voltage generator 130, and the ground voltage VSS from the voltage generator 130. The gate driver 140 may be embodied as a gate driving integrated circuit. The gate driver 140 may be implemented in a circuit with an amorphous silicon gate (ASG) using an amorphous silicon thin film transistor (a-Si TFT), an oxide semiconductor, a crystalline semiconductor, a polycrystalline semiconductor, or the like in addition to the gate driving IC. The gate driver 140 may be substantially simultaneously formed with the pixels PX through a thin film process. In this case, the gate driver 140 may be disposed in a predetermined area (e.g., a non-display area) of one side portion of the display panel 110.

Responsive to the second image signals RGB' and the first control signal CONT1 from the driving controller 120, the data driver 150 outputs grayscale voltages using the first driving voltage VGMA_UH, the second driving voltage VGMA_UL, the third driving voltage VGMA_UH, and the fourth driving voltage VGMA_LL to drive the data lines DL1 to DLm.

While one gate line is driven at a gate-on voltage having a predetermined level by the gate driver 140, the switching transistors of the pixels PX arranged in one row and connected to the one gate line are turned on. Concurrently, the data driver 150 applies the grayscale voltages corresponding to the second image signals RGB' to the data lines DL1 to DLm. The grayscale voltages applied to the data lines DL1 to DLm are applied to corresponding liquid crystal capacitors and corresponding storage capacitors through the turned-on switching transistors. Here, the data driver 150 inverts a polarity of each of the grayscale voltages corresponding to the second image signals RGB' to a positive polarity (+) or a negative polarity (−) at every frame to prevent the liquid crystal capacitors from burning and deteriorating. The first driving voltage VGMA_UH and the second driving voltage VGMA_UL are used to drive the pixels PX at the positive polarity, and the third driving voltage VGMA_LH and the fourth driving voltage VGMA_LL are used to drive the pixels PX at the negative polarity.

The driving controller 120 applies a reference gamma selection signal GCC (interchangeably, "grayscale compensation signal") to the data driver 150 to select a plurality of reference voltages between the first driving voltage VGMA_UH and the second driving voltage VGMA_UL and a plurality of reference voltages between the third driving voltage VGMA_UH and the fourth driving voltage VGMA_LL.

Figure 2:
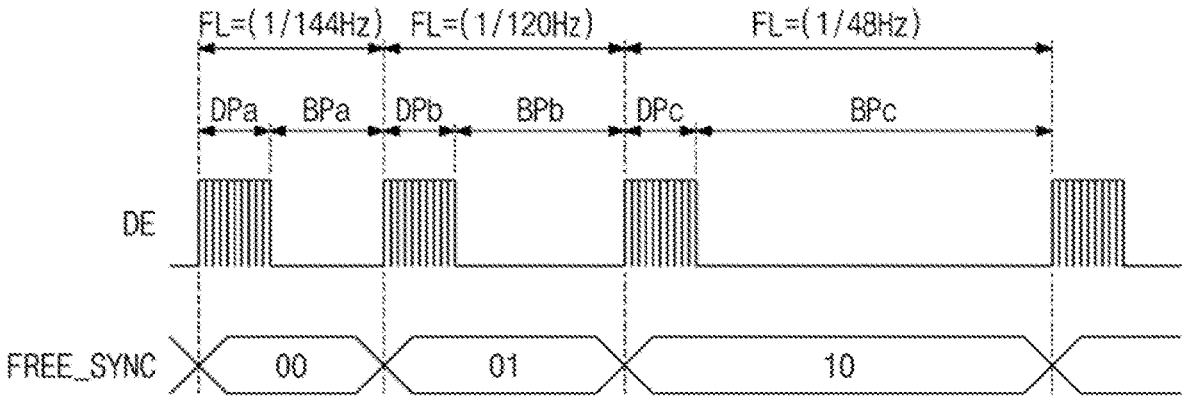
FIG. 2 is a signal diagram showing a data enable signal and a variable frequency signal according to an operating frequency.

FIG. 2 is a signal diagram showing a data enable signal DE and a variable frequency signal according to an operating frequency. The data enable signal DE is included in the control signals CTRL applied to the driving controller 120 from the external source (not shown). The driving controller 120 receives the variable frequency signal FREE_SYNC indicating the operating frequency. As an example, in a case that the variable frequency signal FREE_SYNC is a 2-bit signal, operating frequencies of about 144 Hz, about 120 Hz, and about 48 Hz respectively correspond to '00', '01', and '10' of the variable frequency signal FREE_SYNC. In the example, this results in displaying "a", "b" and "c" consecutive frames with frame lengths FL of (1/144 Hz), (1/120 Hz) and (1/48 Hz), respectively.

According to another embodiment, the variable frequency signal FREE_SYNC may indicate a range of the operating frequency. For instance, the operation frequencies of about 144 to about 121 Hz, about 120 to about 96 Hz, about 95 to about 72 Hz, and about 71 to about 48 Hz may respectively correspond to '00', '01', '10', and '11' of the variable frequency signal FREE_SYNC. Meanwhile, the number of bits of the variable frequency signal FREE_SYNC and the corresponding frequency range may be changed in various ways.

The data enable signal DE includes a display period and a blank period in one frame. As an example, when the operating frequencies are respectively about 144 Hz, about 120 Hz, and about 48 Hz, display periods DPa, DPb, and DPc of the data enable signal DE each have the same time length, but blank periods BPa, BPb, and BPc have different time lengths from each other.

When the blank period of the data enable signal DE becomes longer, i.e., when the operating frequency becomes lower, electric charges charged in the liquid crystal capacitor and the storage capacitor of the pixel PX shown in FIG. 1 decrease due to a leakage current. That is, as the blank period become longer, a luminance of the image displayed through the pixel PX decreases. As an example, in a case that the operating frequency is changed in every frame, the time length of the blank period is changed in every frame, and a luminance decrease amount is changed in every frame. This change in luminance every frame manifests as a flicker phenomenon in which a screen flickers, which in conventional devices is noticeable to a user as a display defect.

Figure 3:
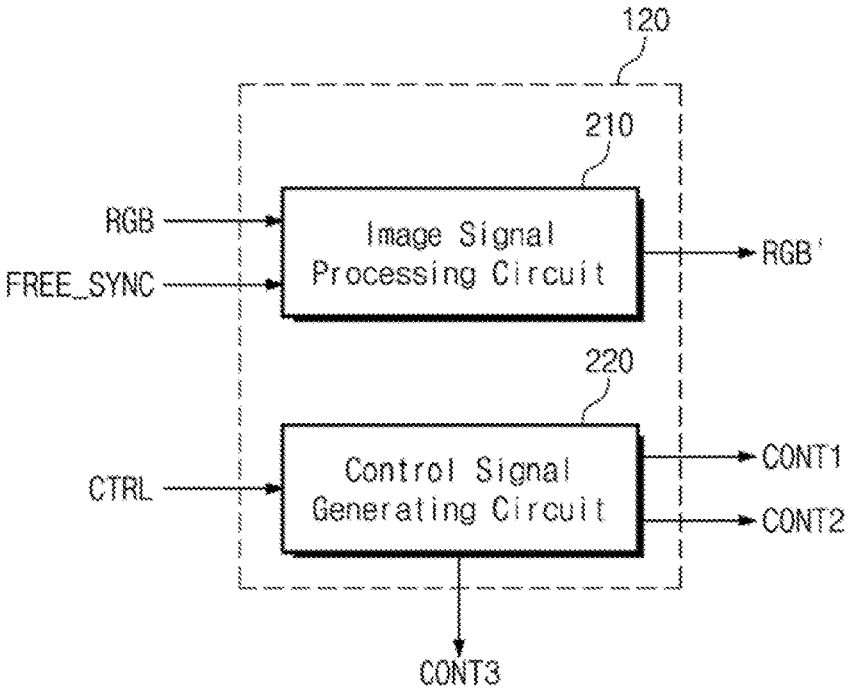
FIG. 3 is a block diagram showing a configuration of a driving controller according to an exemplary embodiment of the present disclosure.

FIG. 3 is a block diagram showing a configuration of the driving controller 120 according to an exemplary embodiment of the present disclosure. In this example, driving controller 120 includes an image signal processing circuit 210 and a control signal generating circuit 220.

The image signal processing circuit 210 outputs the second image signals RGB' obtained by adding the compensation value corresponding to the operation frequency indicated by the variable frequency signal FREE_SYNC to the first image signals RGB. The control signal generating circuit 220 outputs the first control signal CONT1, the second control signal CONT2, and the voltage control signal CONT3 based on the control signals CTRL received from an external source (e.g. a GPU). The first control signal CONT1 includes a horizontal synchronization start signal, a clock signal, and a line latch signal, and the second control signal CONT2 includes a vertical synchronization start signal, an output enable signal, and a gate pulse signal.

When the operation frequency indicated by the variable frequency signal FREE_SYNC is lower than a reference frequency, the image signal processing circuit 210 adds the compensation value having a first value to the first image signals RGB to convert the first image signals to the second image signals RGB'. When the operation frequency indicated by the variable frequency signal FREE_SYNC is equal to or higher than the reference frequency, the image signal processing circuit 210 adds the compensation value having a second value different from the first value to the first image signals RGB to convert the same to the second image signals RGB'.

In the exemplary embodiment shown in FIG. 2, when the variable frequency signal FREE_SYNC indicates one of plural driving frequencies, the reference frequency may be provided in a plural number (e.g., about 144 Hz, about 120 Hz, and about 48 Hz).

Figure 4:
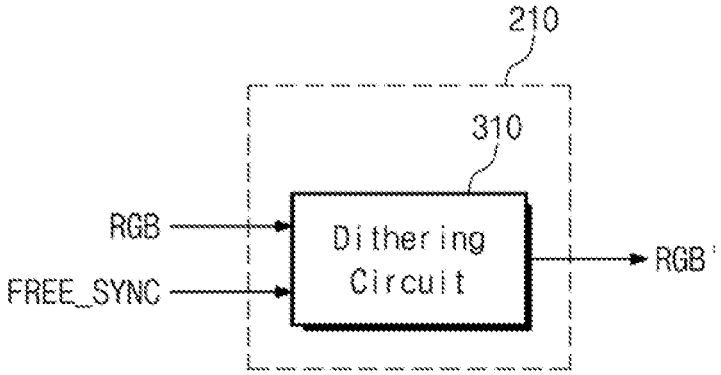
FIG. 4 is a block diagram showing a configuration of an image signal processing circuit according to an exemplary embodiment of the present disclosure.

FIG. 4 is a block diagram showing a configuration of the image signal processing circuit 210 according to an exemplary embodiment of the present disclosure. In this embodiment, image signal processing circuit 210 includes a dithering circuit 310. The dithering circuit 310 dithers the first image signals RGB in response to the operating frequency indicated by the variable frequency signal FREE_SYNC and outputs the second image signals RGB'.

FIGS. 5 to 8 are views showing a dithering operation of the dithering circuit 310 according to an exemplary embodiment of the present disclosure.

Figure 5:
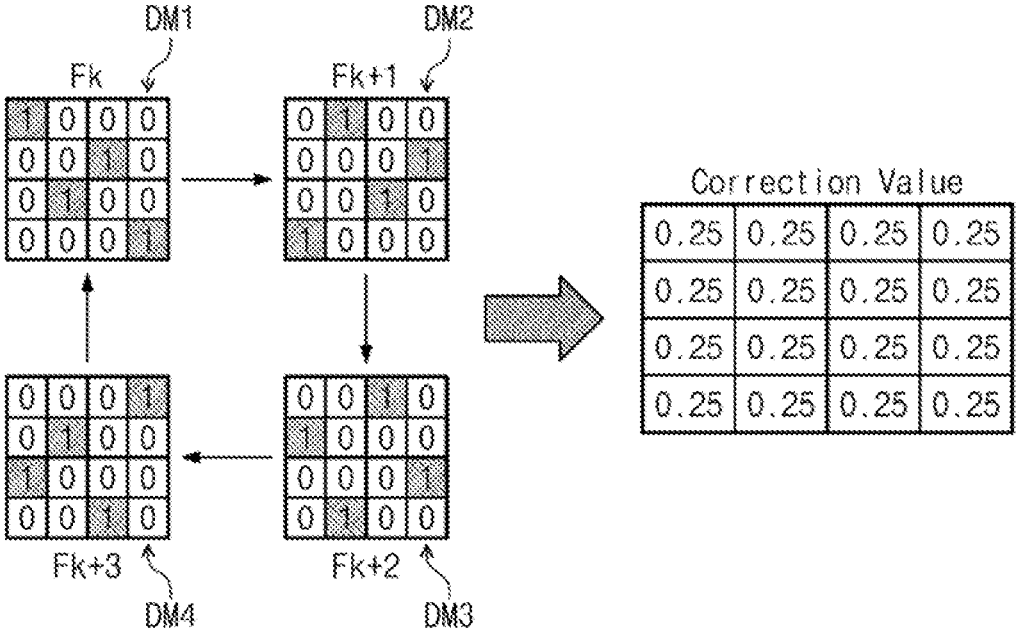
FIGS. 5, 6, 7 and 8 are each a diagram illustrating a respective dithering operation of a dithering circuit according to an exemplary embodiment of the present disclosure.

Referring to FIGS. 4 and 5, the dithering circuit 310 includes a plurality of dithering maps each having a size of "a" by "ID" (each of the "a" and "b" is a positive integer). In the present exemplary embodiment, the dithering circuit 310 dithers the first image signals RGB using the dithering maps DM1 to DM4, each having the size of four rows by four columns.

Each of the dithering maps DM1 to DM4 may compensate for the luminance using a spatial distribution manner in which the position of the number "1" is distributed. As an example, in a case that the first image signals RGB represent 256 grayscales (from 0 to 255) and the display panel 110 (refer to FIG. 1) displays 21.5 grayscale, the 21.5 grayscale may be displayed by displaying 21 grayscale and 22 grayscale through two pixels adjacent to each other and combining the grayscales displayed through the two pixels. That is, the grayscale of the pixels having the size of four rows by four columns in one frame may increase by about 0.25, about 0.5, about 0.75, and about 1 by controlling the position and the number of the "1" of the dithering maps DM1 to DM4.

The dithering circuit 310 dithers the first image signals RGB using the dithering map DM1 in a k-th frame Fk, dithers the first image signals RGB using the dithering map DM2 in a (k+1)th frame Fk+1, dithers the first image signals RGB using the dithering map DM3 in a (k+2)th frame Fk+2, and dithers the first image signals RGB using the dithering map DM4 in a (k+3)th frame Fk+3. In the dithering maps DM1 to DM4, "1" means increasing the grayscale value of the first image signals RGB by "1".

When the first image signals RGB are dithered using the dithering maps DM1 to DM4 during four frames, the second image signals RGB' corresponding to the predetermined pixel are equal to the first image signals RGB of which the grayscale value increases by about 0.25. That is, an average compensation value corresponding to each pixel is about 0.25 during the four frames.

The dithering circuit 310 may temporally and spatially dither the first image signals RGB using the dithering maps DM1 to DM4 shown in FIG. 5 to output the second image signals RGB'.

Figure 6:
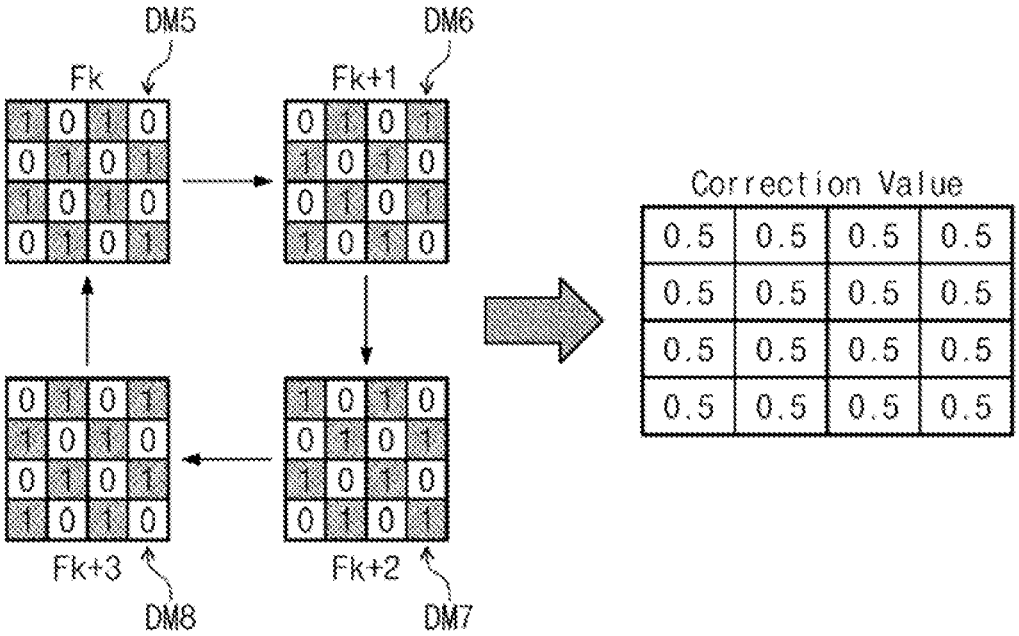

Referring to FIGS. 4 and 6, the dithering circuit 310 dithers the first image signals RGB using a dithering map DM5 in the k-th frame Fk, dithers the first image signals RGB using a dithering map DM6 in the (k+1)th frame Fk+1, dithers the first image signals RGB using a dithering map DM7 in the (k+2)th frame Fk+2, and dithers the first image signals RGB using a dithering map DM8 in the (k+3)th frame Fk+3.

When the first image signals RGB are dithered using the dithering maps DM5 to DM8 during the four frames, the second image signals RGB' corresponding to the predetermined pixel increase by about 0.5 more than the grayscale of the first image signals RGB. That is, the average compensation value corresponding to each pixel is about 0.5 during the four frames.

The dithering circuit 310 may temporally and spatially dither the first image signals RGB using the dithering maps DM5 to DM8 shown in FIG. 6 to output the second image signals RGB'.

Figure 7:
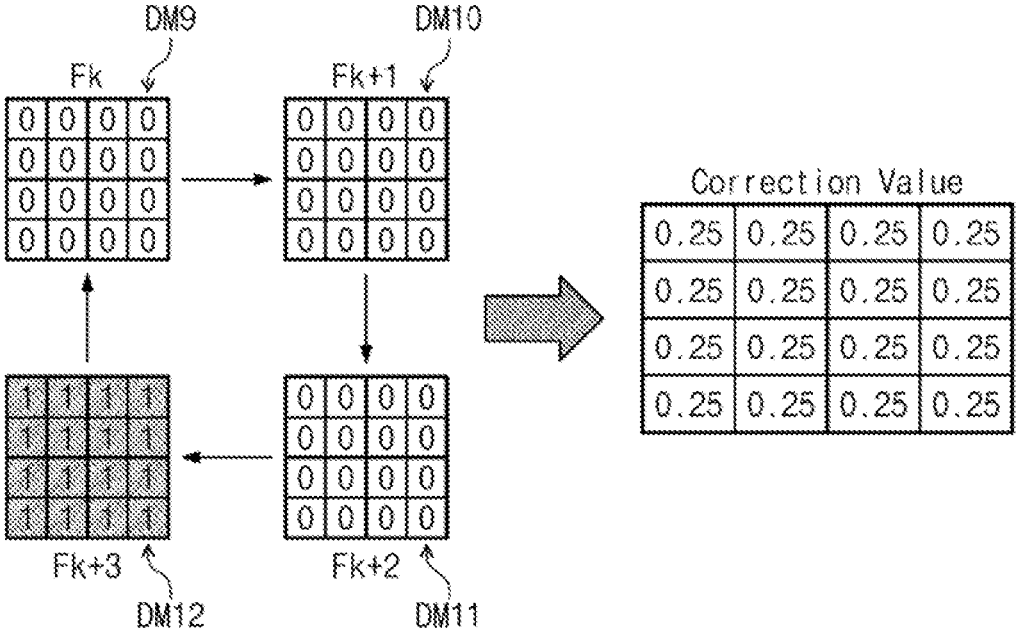

Referring to FIGS. 4 and 7, the dithering circuit 310 dithers the first image signals RGB using a dithering map DM9 in the k-th frame Fk, dithers the first image signals RGB using a dithering map DM10 in the (k+1)th frame Fk+1, dithers the first image signals RGB using a dithering map DM11 in the (k+2)th frame Fk+2, and dithers the first image signals RGB using a dithering map DM12 in the (k+3)th frame Fk+3.

When the first image signals RGB are dithered using the dithering maps DM9 to DM12 during the four frames, the second image signals RGB' corresponding to the predetermined pixel are equal to the first image signals of which the grayscale value increases by about 0.25. That is, the average compensation value corresponding to each pixel is about 0.25 during the four frames.

The dithering circuit 310 may temporally and spatially dither the first image signals RGB using the dithering maps DM9 to DM12 shown in FIG. 7 to output the second image signals RGB'.

Figure 8:
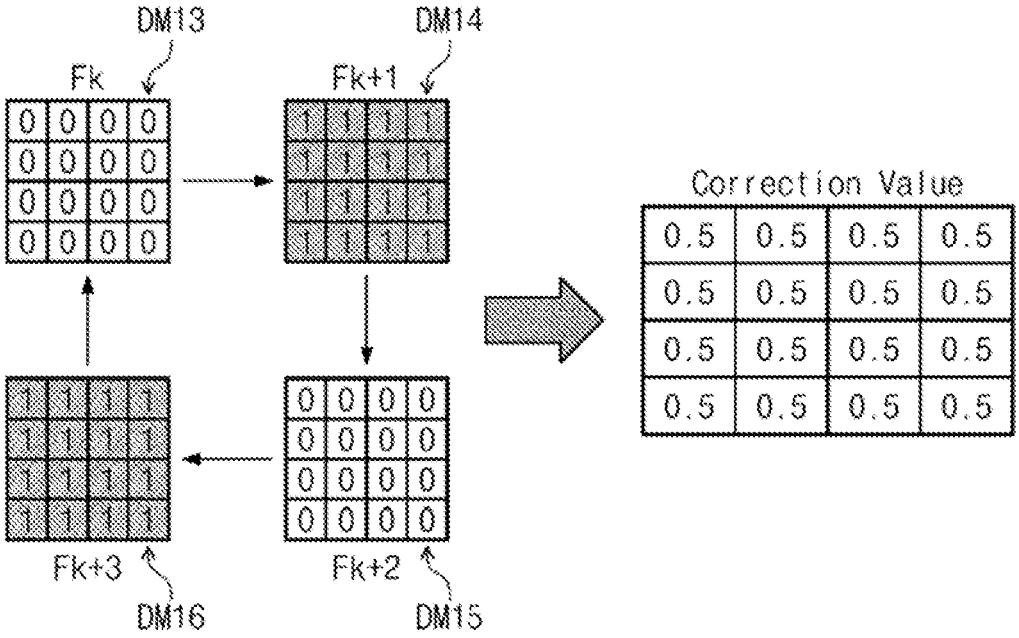

Referring to FIGS. 4 and 8, the dithering circuit 310 dithers the first image signals RGB using a dithering map DM13 in the k-th frame Fk, dithers the first image signals RGB using a dithering map DM14 in the (k+1)th frame Fk+1, dithers the first image signals RGB using a dithering map DM15 in the (k+2)th frame Fk+2, and dithers the first image signals RGB using a dithering map DM16 in the (k+3)th frame Fk+3.

When the first image signals RGB are dithered using the dithering maps DM13 to DM16 during the four frames, the second image signals RGB' corresponding to the predetermined pixel increase by about 0.5 more than the grayscale of the first image signals RGB. That is, the average compensation value corresponding to each pixel is about 0.5 during the four frames.

The dithering circuit 310 may temporally and spatially dither the first image signals RGB using the dithering maps DM13 to DM15 shown in FIG. 8 to output the second image signals RGB'.

The compensation value in FIGS. 5 to 8 shows only embodiments in which the compensation values are respectively about 0.25 and about 0.5, but the compensation value may be changed in various ways depending on the size of the dithering map and the number of dithering frames.

As shown in FIG. 2, when the variable frequency signal FREE_SYNC represents '00', '01', and '10' respectively corresponding to the operating frequencies of about 144 Hz, about 120 Hz, and about 48 Hz, the dithering circuit 310 selects one of 0, 0.25, and 0.5 as the compensation value according to the variable frequency signal FREE_SYNC. The dithering circuit 310 selects the dithering maps corresponding to the selected compensation value and performs the dithering operation on the first image signals RGB, and thus the dithering circuit 310 outputs the second image signals RGB' to which the compensation value is applied.

Figure 9:
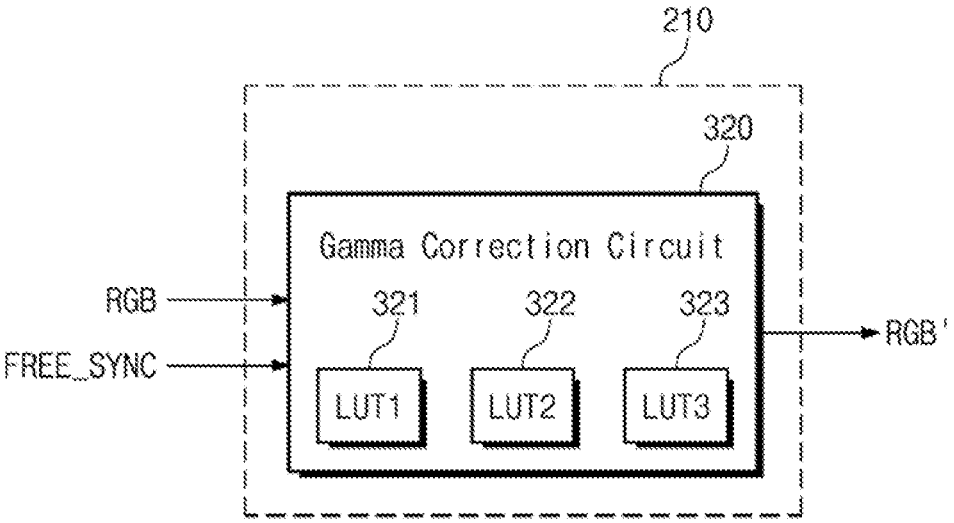
FIG. 9 is a block diagram showing an image signal processing circuit according to another exemplary embodiment of the present disclosure.

FIG. 9 is a block diagram showing an image signal processing circuit 210 according to another exemplary embodiment of the present disclosure. The image signal processing circuit 210 of FIG. 9 includes a gamma correction circuit 320, a first lookup table 321, a second lookup table 322, and a third lookup table 323.

The first lookup table 321, the second lookup table 322, and the third lookup table 323 respectively correspond to a different operating frequency and each stores a different set of gamma compensation values. As an example, the first lookup table 321 corresponds to the operating frequency of about 144 Hz, the second lookup table 322 corresponds to the operating frequency of about 120 Hz, and the third lookup table 323 corresponds to the operating frequency of about 48 Hz.

The gamma correction circuit 320 selects one of the first lookup table 321, the second lookup table 322, and the third lookup table 323, which corresponds to the variable frequency signal FREE_SYNC. The gamma correction circuit 320 corrects the first signals RGB with reference to the selected lookup table and outputs the second image signals RGB'.

The number of the lookup tables included in the image signal processing circuit 210 and a relation between each lookup table and the corresponding operating frequency may be changed in various ways.

Figure 10:
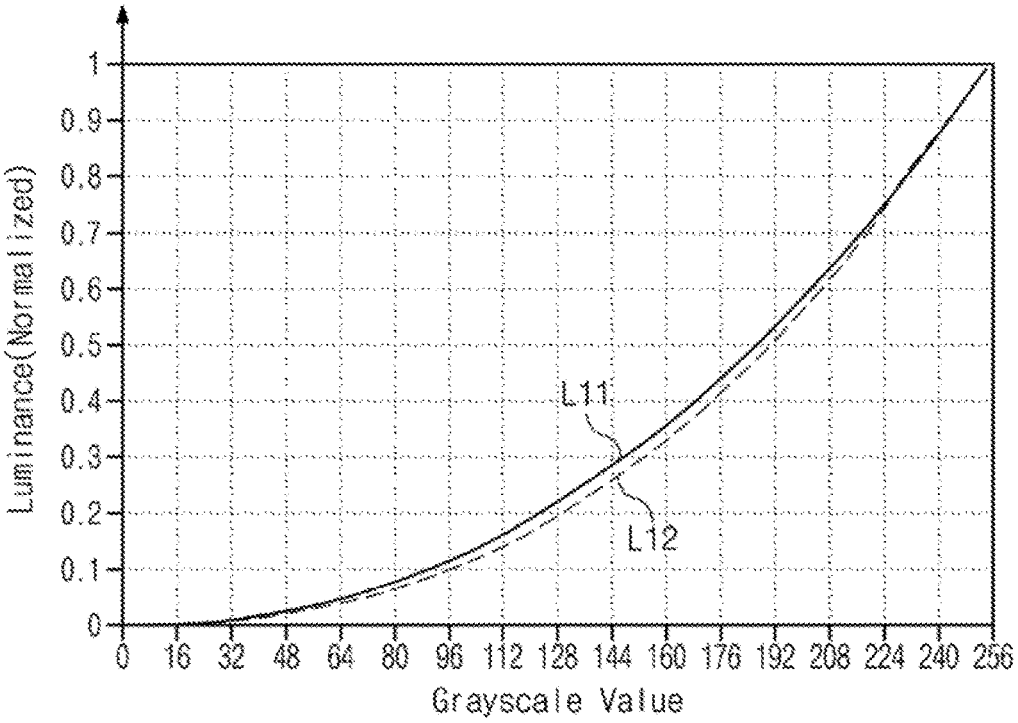
FIG. 10 is a graph showing a luminance of an image signal displayed on a display panel depending on an operation frequency when a compensation value of a gamma correction circuit shown in FIG. 9 is zero (0)
Figure 11:
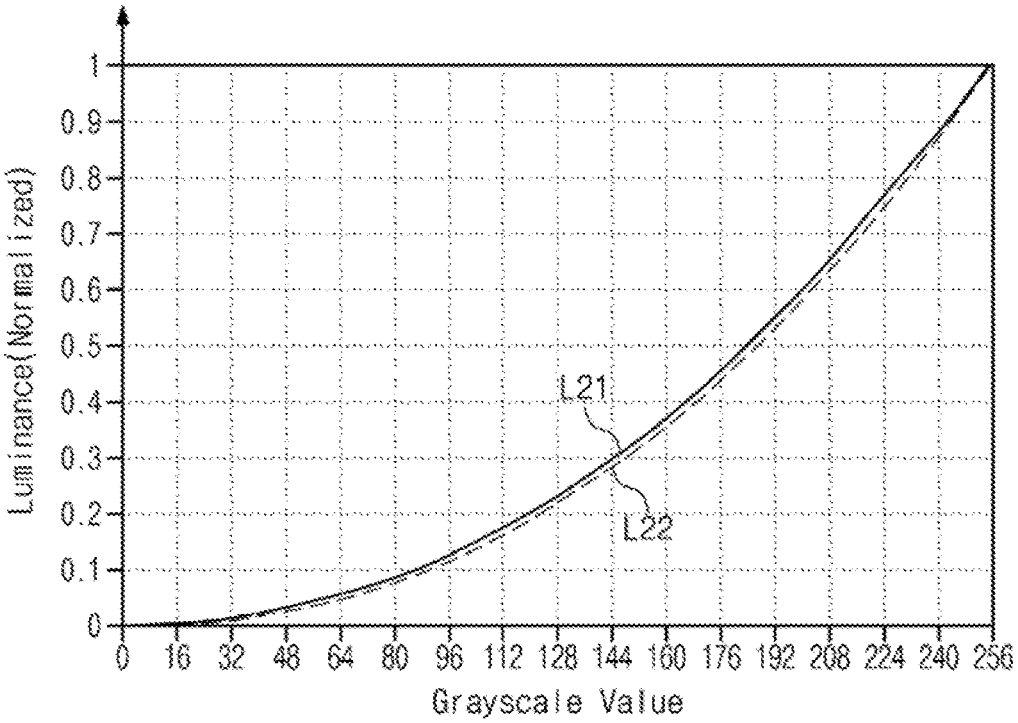
FIG. 11 is a graph showing the luminance of an image signal displayed on the display panel depending on the operation frequency when the gamma correction circuit performs a gamma correction operation using a first, second, and third lookup table.

FIG. 10 is a graph showing luminance of an image signal (vs. the grayscale value used for the image signal) displayed on the display panel depending on the operation frequency when the compensation value of the gamma correction circuit 320 shown in FIG. 9 is zero (0). FIG. 11 is a graph showing the luminance of the image signal (vs. the grayscale value) displayed on the display panel depending on the operation frequency when the gamma correction circuit carries out the gamma correction operation using the first, second, and third lookup tables.

As shown in FIG. 10, a luminance curve L12 when the operation frequency is relatively low (e.g., about 48 Hz) is located below a luminance curve L11 when the operation frequency is relatively high (e.g., about 144 Hz). That is, although the grayscale signal applied to the display panel 110 (refer to FIG. 1) is the same level, the luminance drop is greater when the operation frequency is relatively low (i.e., when the length of the blank period is relatively long) as compared to when the operation frequency is relatively high. In particular, in the absence of luminance compensation, the luminance drop at the end of the blank period, due to capacitive discharge in the pixels, is more significant for the longer blank period (coinciding with the relatively low operation frequency). Consequently, the average luminance for the pixel over the frame is also lower at the lower operation frequency.

Referring to FIGS. 9 and 11, in the case that the gamma correction circuit 320 carries out the gamma correction operation, a luminance curve L22 representing luminance when the operation frequency is relatively low (e.g., about 48 Hz) rises above the luminance curve L12 shown in FIG. 10, and thus the luminance curve L22 approaches a luminance curve L21 representing luminance when the operation frequency is relatively high (e.g., about 144 Hz).

Figure 12:
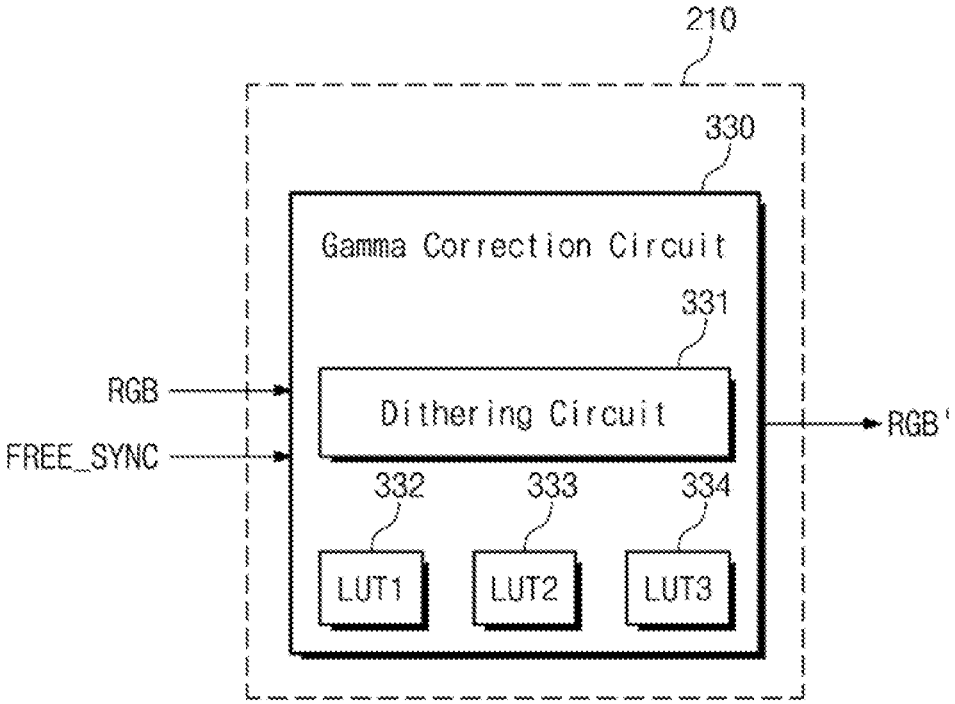
FIG. 12 is a block diagram showing an image signal processing circuit according to another exemplary embodiment of the present disclosure.

FIG. 12 is a block diagram showing an image signal processing circuit 210 according to another exemplary embodiment of the present disclosure. The the image signal processing circuit 210 of FIG. 12 includes a gamma correction circuit 330, which in turn includes a dithering circuit 331, a first lookup table 332, a second lookup table 333, and a third lookup table 334.

Similar to the gamma correction circuit 320 shown in FIG. 9, the gamma correction circuit 320 corrects the first image signals RGB using the first lookup table 332, the second lookup table 333, and the third lookup table 334 to output the second image signals RGB'. In a case that a compensation value stored in the first lookup table 332, the second lookup table 333, and the third lookup table 334 is smaller than 1, the gamma correction circuit 330 may output the second image signals RGB' using the dithering circuit 331. The operation of the dithering circuit 331 may be the same as that described with reference to FIGS. 4 to 8, and thus details thereof will be omitted.

Figure 13:
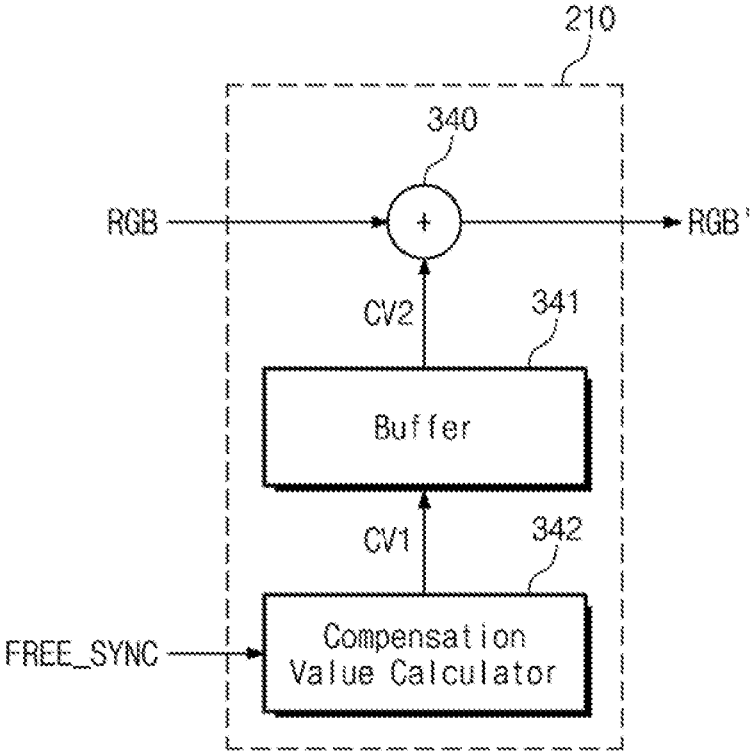
FIG. 13 is a block diagram showing an image signal processing circuit according to another exemplary embodiment of the present disclosure.

FIG. 13 is a block diagram showing an image signal processing circuit 210 according to another exemplary embodiment of the present disclosure. The image signal processing circuit 210 of FIG. 13 includes an adder 340, a buffer 341, and a compensation value calculator 342. The compensation value calculator 342 calculates a first compensation value CV1 corresponding to the variable frequency signal FREE_SYNC. The buffer 341 delays the first compensation value CV1 to output a second compensation value CV2. In the present exemplary embodiment, the buffer 341 delays the first compensation value CV1 for one frame to output the second compensation value CV2. That is, the second compensation value CV2 is a compensation value corresponding to the variable frequency signal FREE_SYNC of a previous frame. According to yet another embodiment, the buffer 341 may delay the first compensation value CV1 for several frames to output the second compensation value CV2.

The adder 340 adds the first image signals RGB of a present frame to the second compensation value CV2 of the previous frame and outputs the second image signals RGB'.

Figure 14:
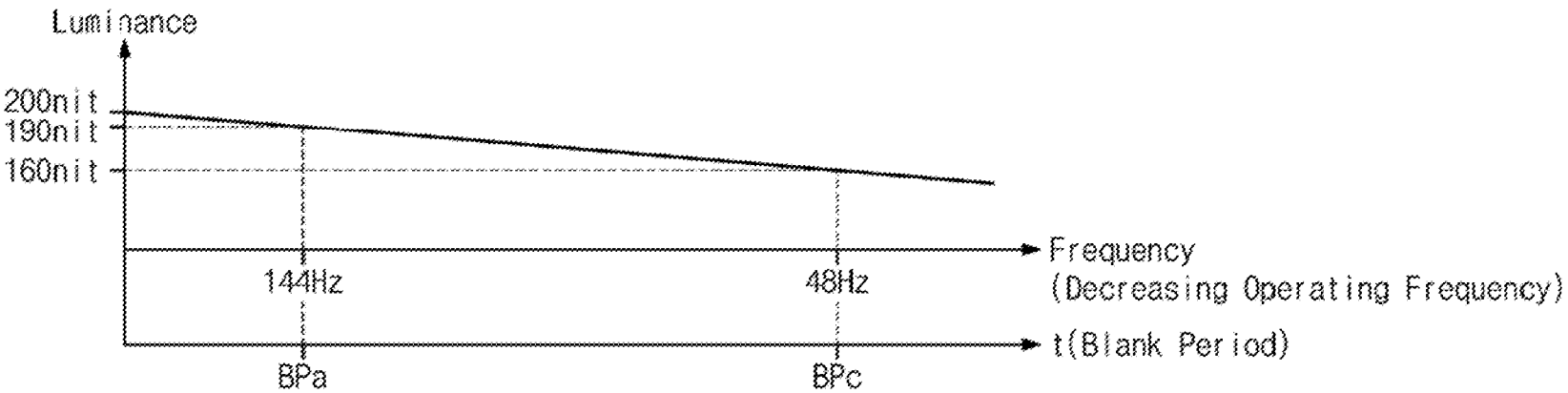
FIG. 14 is a graph showing an example variation in luminance of the displayed image depending on the operating frequency.

FIG. 14 is a graph showing an example variation in luminance of the displayed image depending on the operating frequency. As described with reference to FIG. 2, as the operating frequency decreases, the blank period becomes longer, and thus the luminance of the display image is lowered due to capacitive discharge in the pixel.

When assuming that the luminance of the display image is about 200 nit in the display period in FIG. 14, the luminance of the display image when the operating frequency is about 144 Hz (coinciding with a blank period BPa as shown in FIG. 2) is reduced more than that when the operating frequency is about 48 Hz (coinciding with the longer blank period BPc).

The image signal processing circuit 210 shown in FIG. 13 compensates for the luminance of the present frame based on the operating frequency of the previous frame, and thus a difference in luminance between the frames decreases.

The following Table 1 shows the variation in luminance depending on the change of the operating frequency in a series of frames. The example presented is one that may occur in real time rendering, in which a lower frequency frame (48 Hz) is intermittently inserted in a frame sequence in an isolated manner, such that a lower frequency frame that is not a first frame or a last frame of the frame sequence is always preceded by, and succeeded by, a higher frequency frame (144 Hz). On the other hand, the number of consecutive frames that may be the higher frequency frame may be unlimited. The compensation technique for this scenario discussed below may be similarly applied to other situations with more than two permissible frame frequencies, and/or where it is permitted to insert two or more consecutive low frequency frames in the sequence.

TABLE 1

| Frame | F − 4 | F − 3 | F − 2 | F − 1 | F | F + 1 | F + 2 | F + 3 | F + 4 |
|---|---|---|---|---|---|---|---|---|---|
| Operation frequency | 144 | 144 | 48 | 144 | 48 | 144 | 144 | 144 | 48 |
| Luminance (nit) of display image in conventional art | 190 | 190 | 160 | 190 | 160 | 190 | 190 | 190 | 160 |

TABLE 1-continued

| Frame | F − 4 | F − 3 | F − 2 | F − 1 | F | F + 1 | F + 2 | F + 3 | F + 4 |
|---|---|---|---|---|---|---|---|---|---|
| Luminance difference (Fk − 1 to Fk) | — | 0 | −30 | +30 | −30 | +30 | 0 | 0 | −30 |
| First compensation signal (CV1) | +10 | +10 | −5 | +10 | −5 | +10 | +10 | +10 | −10 |
| Second compensation signal (CV2) | — | +10 | +10 | −5 | +10 | −5 | +10 | +10 | +10 |
| Luminance (nit) of display image in present disclosure | — | 200 | 170 | 185 | 170 | 185 | 200 | 200 | 170 |
| Luminance difference (Fk − 1 to Fk) | | +10 | −30 | +15 | −15 | +15 | +15 | 0 | 30 |

In Table 1, when assuming that the luminance of the display image corresponding to the second image signals RGB" in the display period is about 200 nit, the luminance of the display image decreases to about 190 nit in a case that the operation frequency is about 144 Hz, and the luminance of the display image decreases to about 160 nit in a case that the operation frequency is about 48 Hz.

When the variable frequency signal FREE_SYNC of an (F−1)th frame indicates the operation frequency of about 144 Hz, the compensation value calculator 342 outputs the first compensation signal CV1 to increase the luminance by 10 nit. The buffer 341 stores the first compensation signal CV1.

When the first image signals RGB are input in an F-th frame, the buffer 341 outputs the first compensation signal CV1 stored therein as the second compensation signal CV2. The adder 340 adds the first image signals RGB to the second compensation signal CV2, resulting in the second image signals RGB'.

Accordingly, although the operation frequency is about 48 Hz in the F-th frame, the luminance decreases to about 170 nit, and thus the decrease of the luminance is reduced when compared with the luminance of about 160 nit in the conventional art.

In this example, as noted above, the low frequency frames (48 Hz) are intermittently included in the frame sequence in an isolated manner, while it is permissible to have many consecutive high frequency (144 Hz) frames. If a present frame is a 144 Hz frame, by presenting a positive compensation value, e.g., +10 nit, the next frame will always have a luminance of either 200 nit (for a 144 Hz next frame) or 170 nit (for a 48 Hz next frame). If, on the other hand, the present frame is 48 Hz, by presenting a negative compensation value, e.g., −5 nit, luminance of the next frame will always be 185 nit. Thus, the frame to frame luminance variation is reduced compared to the conventional art, whereby visual artifacts like flickering may be diminished.

The difference in luminance between consecutive frames may decrease by determining the first compensation signal CV1 based on the variable frequency signal FREE_SYNC of the previous frame, i.e., the operation frequency and adding the second compensation signal CV2 corresponding to the operation frequency of the previous frame to the first image signals RGB of the present frame to output the second image signal RGB'.

As represented by Table 1, the luminance differences of the conventional art in consecutive frames F−3. F−2, F−1, F, F+1, F+2, F+3, and F+4 are 0, −30, +30, −30, 0, 0, and −30, respectively. The luminance differences of the present disclosure in the consecutive frames F−3, F−2, F−1, F, F+1, F+2, F+3, and F+4 are changed to +10, −30, +15, +15, +15, +15, 0, and 30, respectively by outputting the second image signals RGB' obtained by adding the second compensation signal CV2 to the first image signals RGB. That is, the luminance difference between the frames adjacent to each other may decrease according to the image signal processing circuit 210 shown in FIG. 13.

Figure 15:
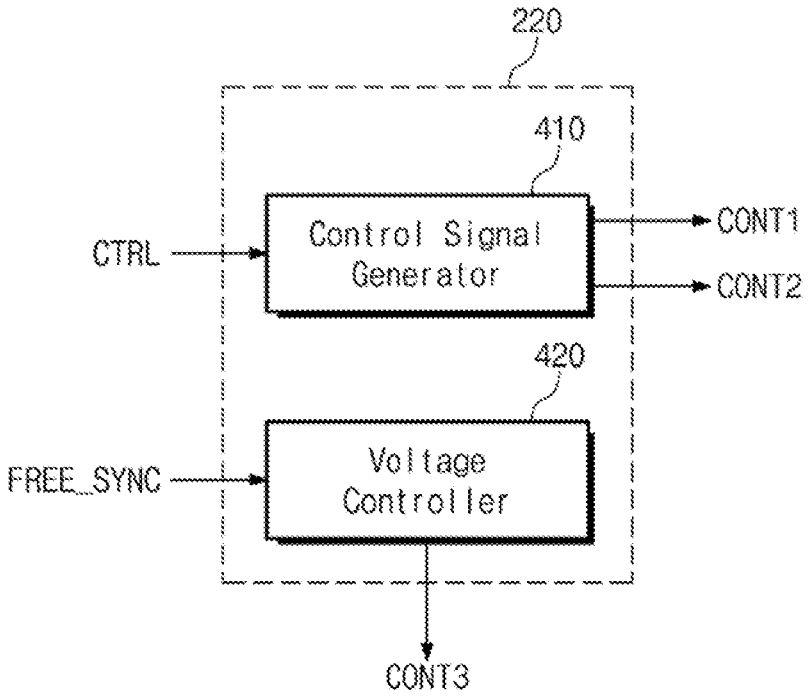
FIG. 15 is a block diagram showing a configuration of a control signal generating circuit according to an exemplary embodiment of the present disclosure.

FIG. 15 is a block diagram showing a configuration of the control signal generating circuit 220 according to an exemplary embodiment of the present disclosure. The control signal generating circuit 220 of FIG. 15 includes a control signal generator 410 and a voltage controller 420. The control signal generator 410 outputs the first control signal CONT1 and the second control signal CONT2 based on the control signals CTRL from the external source. The voltage controller 420 outputs the voltage control signal CONT3 in response to the variable frequency signal FREE_SYNC. Example control of driving voltages with the voltage control signal CONT3 is shown in FIG. 16.

Figure 16:
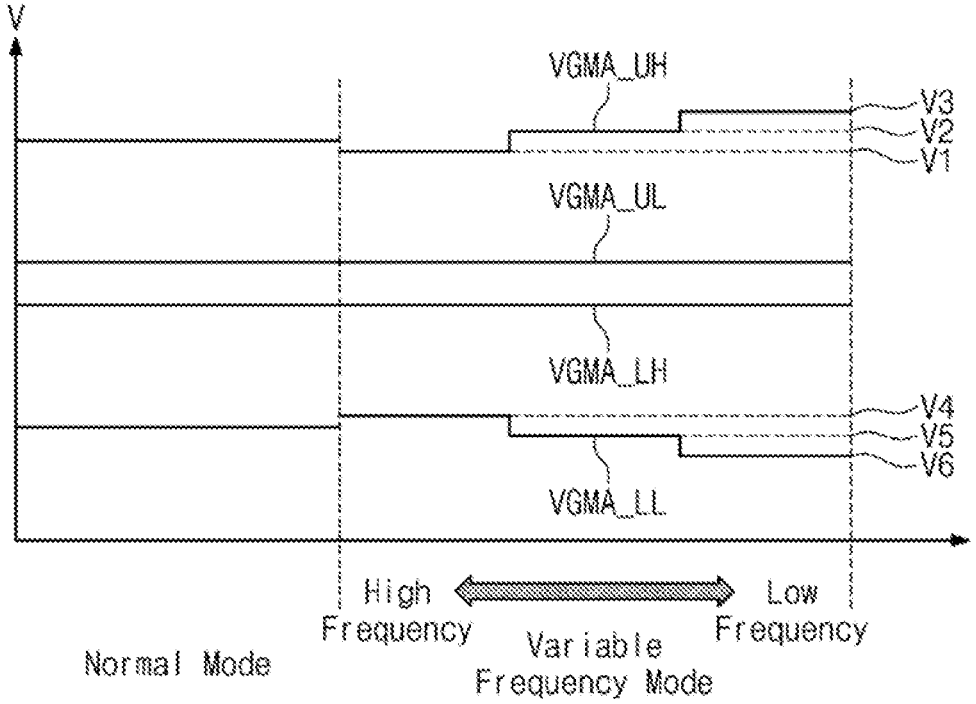
FIG. 16 is a signal diagram showing voltage levels of driving voltages generated by a voltage generator shown in FIG. 1.

FIG. 16 is a signal diagram showing voltage levels of driving voltages generated by the voltage generator 130 shown in FIG. 1, in an embodiment including the control signal generating circuit 220 of FIG. 15. The voltage generator 130 sets the voltage level of the first driving voltage VGMA_UH, the second driving voltage VGMA_UL, the third driving voltage VGMA_LH, and the fourth driving voltage VGMA_LL in response to the voltage control signal CONT3 from the voltage controller 420 shown in FIG. 15.

Each of the first, second, third, and fourth driving voltages VGMA_UH, VGMA_UL, VMA_LH, and VGMA_LL is fixed to a predetermined level during a normal mode in which the operation frequency is fixed.

Each of the first, second, third, and fourth driving voltages VGMA_UH, VGMA_UL, VMA_LH, and VGMA_LL is controllably changed or maintained depending on the voltage control signal CONT3 based on the variable frequency signal FREE_SYNC during a variable frequency mode in which the operation frequency is selectively changed or maintained every frame. In the present exemplary embodiment, only the first and fourth driving voltages VGMA_UH and VGMA_LL are changed depending on the operation frequency during the variable frequency mode, and the second and third driving voltages VGMA_UL and VGMA_LH are maintained at a predetermined level.

As an example, when the variable frequency signal FREE_SYNC represents about 144 Hz, about 120 Hz, and about 48 Hz, the voltage controller 420 outputs the voltage control signal CONT3 such that the first driving voltage VGMA_UH is set to a first level V1, a second level V2, and a third level V3 depending on the variable frequency signal FREE_SYNC.

For instance, when the variable frequency signal FREE_SYNC represents about 144 Hz, about 120 Hz, and about 48 Hz, the voltage controller 420 outputs the voltage control signal CONT3 such that the fourth driving voltage VGMA_LL is set to a fourth level V4, a fifth level V5, and a sixth level V6 depending on the variable frequency signal FREE_SYNC.

Figure 17:
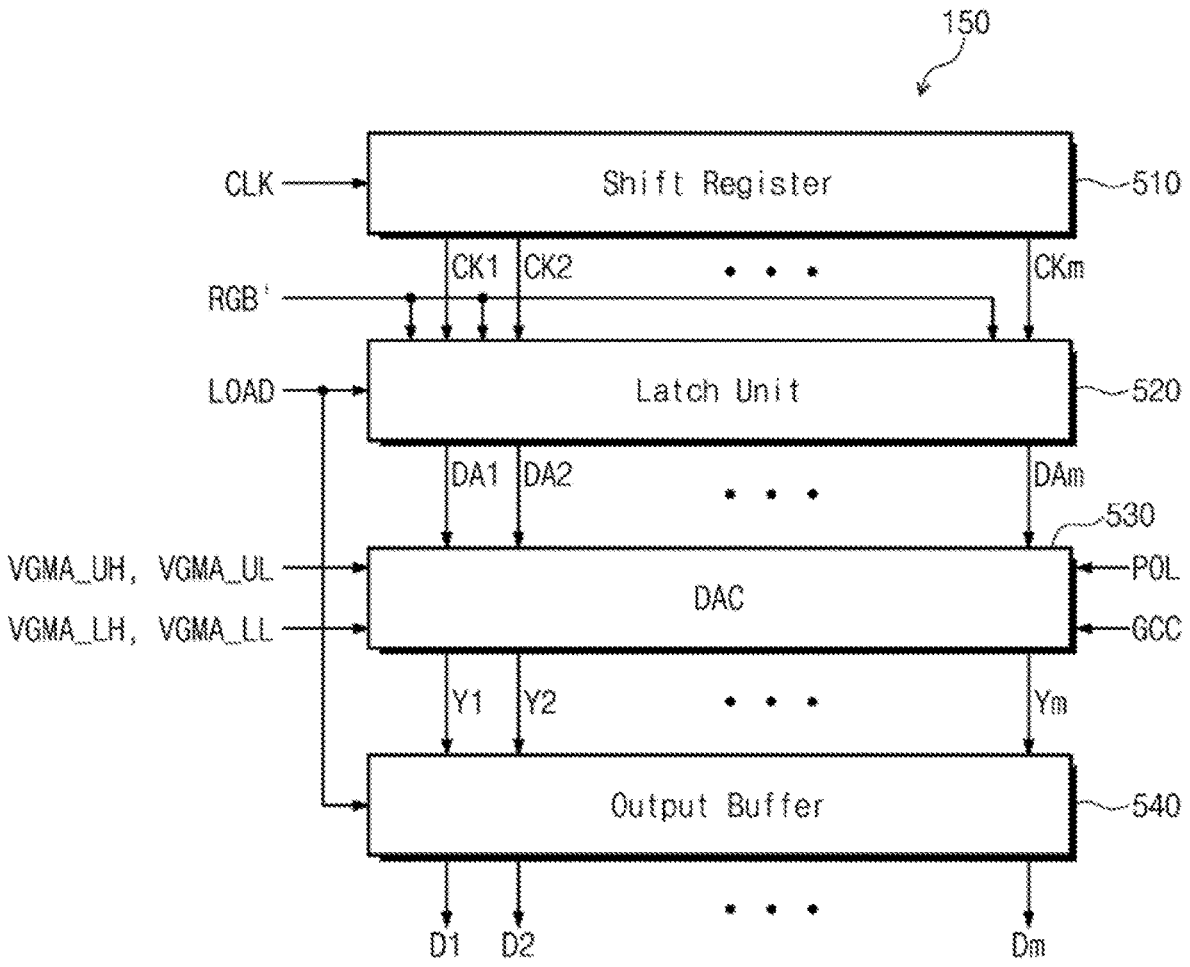
FIG. 17 is a block diagram showing a configuration of a data driver according to an exemplary embodiment of the present disclosure.

FIG. 17 is a block diagram showing a configuration of the data driver 150 according to an exemplary embodiment of the present disclosure. The data driver 150 of FIG. 17 includes a shift register 510, a latch unit 520, a digital-to-analog converter 530, and an output buffer 540. In FIG. 17, a clock signal CLK, a line latch signal LOAD, a polarity inversion signal POL are signals included in the first control signal CONT1 provided from the driving controller 120 shown in FIG. 1.

The shift register 510 sequentially activates latch clock signals CK1 to CKm in synchronization with the clock signal CLK. The latch unit 520 latches the second image signals RGB' in synchronization with the latch clock signals CK1 to CKm from the shift register 510 and applies latch data signals DA1 to DAm to the digital-to-analog converter 530 in response to the line latch signal LOAD.

The digital-to-analog converter 530 receives the polarity inversion signal POL and the grayscale compensation signal GCC from the driving controller 120 shown in FIG. 1 and the first driving voltage VGMA_UH, the second driving voltage VGMA_UL, the third driving voltage VGMA_LH, and the fourth driving voltage VGMA_LL from the voltage generator 130 shown in FIG. 1. The digital-to-analog converter 530 outputs grayscale voltages Y1 to Ym corresponding to the latch data signals DA1 to DAm from the latch unit 520 to the output buffer 540. The output buffer 540 outputs the grayscale voltages Y1 to Ym from the digital-to-analog converter 530 to the data lines DL1 to DLm in response to the line latch signal LOAD.

Figure 18:
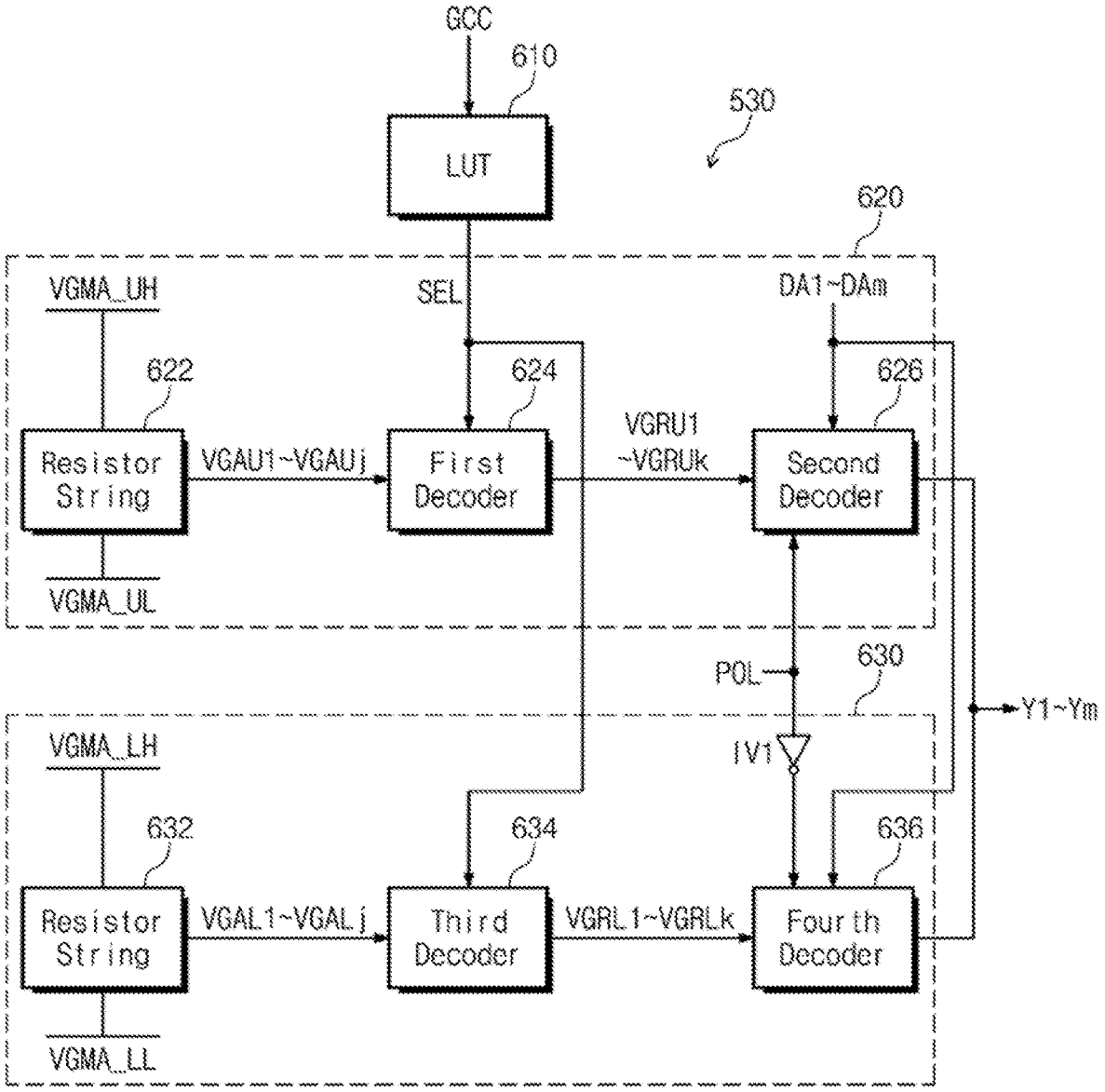
FIG. 18 is a block diagram showing a configuration of a digital-to-analog converter shown in FIG. 17 according to an exemplary embodiment of the present disclosure.

FIG. 18 is a block diagram showing a configuration of the digital-to-analog converter 530 shown in FIG. 17 according to an exemplary embodiment of the present disclosure. The digital-to-analog converter 530 of FIG. 18 includes a lookup table 610, a positive polarity converter 620, and a negative polarity converter 630. The lookup table 610 stores a plurality of grayscale selection signals and outputs a selection signal SEL in response to the grayscale compensation signal GCC from the driving controller 120 shown in FIG. 1.

The positive polarity converter 620 includes a resistor string 622, a first decoder 624, and a second decoder 626. The resistor string 622 receives the first driving voltage VGMA_UH and the second driving voltage VGMA_UL from the voltage generator 130 shown in FIG. 1 and generates a plurality of gamma voltages VGAU1 to VGAUj.

The first decoder 624 outputs some gamma voltages among the gamma voltages VGAU1 to VGAUj as a plurality of gamma reference voltages VGRU1 to VGRUk in response to the selection signal SEL from the lookup table 610. In the present exemplary embodiment, each of "j" and "k" is a positive integer. The second decoder 626 converts the latch data signals DA1 to DAm to the grayscale voltages Y1 to Ym with reference to the gamma reference voltages VGRU1 to VGRUk while the polarity inversion signal POL is at a first level.

The negative polarity converter 630 includes a resistor string 632, a third decoder 634, a fourth decoder 636, and an inverter IV1. The resistor string 632 receives the third driving voltage VGMA_LH and the fourth driving voltage VGMA_LL from the voltage generator 130 shown in FIG. 1 and generates a plurality of gamma voltages VGAL1 to VGALj.

The third decoder 634 outputs some gamma voltages among the gamma voltages VGAL1 to VGAUj as a plurality of gamma reference voltages VGRL1 to VGRLk in response to the selection signal SEL from the lookup table 610. In the present exemplary embodiment, each of "j" and "k" is a positive integer. The fourth decoder 636 converts the latch data signals DA1 to DAm to the grayscale voltages Y1 to Ym with reference to the gamma reference voltages VGRL1 to VGRLk while the polarity inversion signal POL is at a second level.

Referring to FIGS. 15 to 18, when the voltage levels of the first, second, third, and fourth driving voltages VGMA_UH, VGMA_UL, VGMA_LH, and VGMA_LL are changed depending on the operation frequency indicated by the variable frequency signal FREE_SYNC, voltage levels of the gamma voltages VGAU1 to VGAUj and VGAL1 to VGALj output from the resistor strings 622 and 632 may be changed.

In particular, as the operation frequency indicated by the variable frequency signal FREE_SYNC becomes lower, the voltage level of the first driving voltage VGMA_UH becomes higher (V1<V2<V3), and the voltage level of the fourth driving voltage VGMA_LL becomes lower (V4<V5<V6). As the voltage level of the first driving voltage VGMA_UH becomes higher and the voltage level of the fourth driving voltage VGMA_LL becomes lower, the luminance of the image displayed through the display panel 110 (refer to FIG. 1) becomes higher.

According to the present exemplary embodiment, the decrease of the luminance, which is caused by the blank period that becomes longer at the low operation frequency (e.g., about 48 Hz), may be compensated by changing the voltage level of the first, second, third, and fourth driving voltages VGMA_UH, VGMA_UL, VGMA_LH, and VGMA_LL. In one embodiment, the decrease of the luminance may be compensated by such variation of these driving voltages with the operating frequency as just described, without changing the grayscale values of the first image signals RGB to different values in the second image signals RGB'. That is, in this case, no compensation value is added to the first image signals RGB, whereby the second image signals RGB' may be substantially the same signals as the first image signals RGB. In an alternative embodiment, luminance may be compensated by a combination of varying the first through fourth driving voltages VGMA_UH, VGMA_UL, VGMA_LH, and VGMA_LL as described for FIGS. 15-18, and adding a compensation value as a function of operation frequency to the first image signals RGB to generate the second image signals RGB' having different grayscale values.

Referring to FIGS. 1 and 18, the driving controller 120 outputs the grayscale compensation signal GCC in response to the variable frequency signal FREE_SYNC. As described above, the lookup table 610 outputs the selection signal SEL in response to the grayscale compensation signal GCC. During the variable frequency mode, the voltage level of the first, second, third, and fourth driving voltages VGMA_UH, VGMA_UL, VGMA_LH, and VGMA_LL may maintain the voltage level of the normal mode and change the gamma reference voltages VGRU1 to VGRUk and VGRL1 to VGRLk, which are selected by changing the grayscale compensation signal GCC and changing the selection signal SEL.

Since the voltage level of the gamma reference voltages VGRU1 to VGRUk and VGRL1 to VGRLk selected at the high operation frequency (e.g., about 144 Hz) and the voltage level of the gamma reference voltages VGRU1 to VGRUk and VGRL1 to VGRLk selected at the low operation frequency (e.g., about 48 Hz) are set to be different from each other, the luminance variation caused by the changing of the operation frequency may be minimized.

Figure 19:
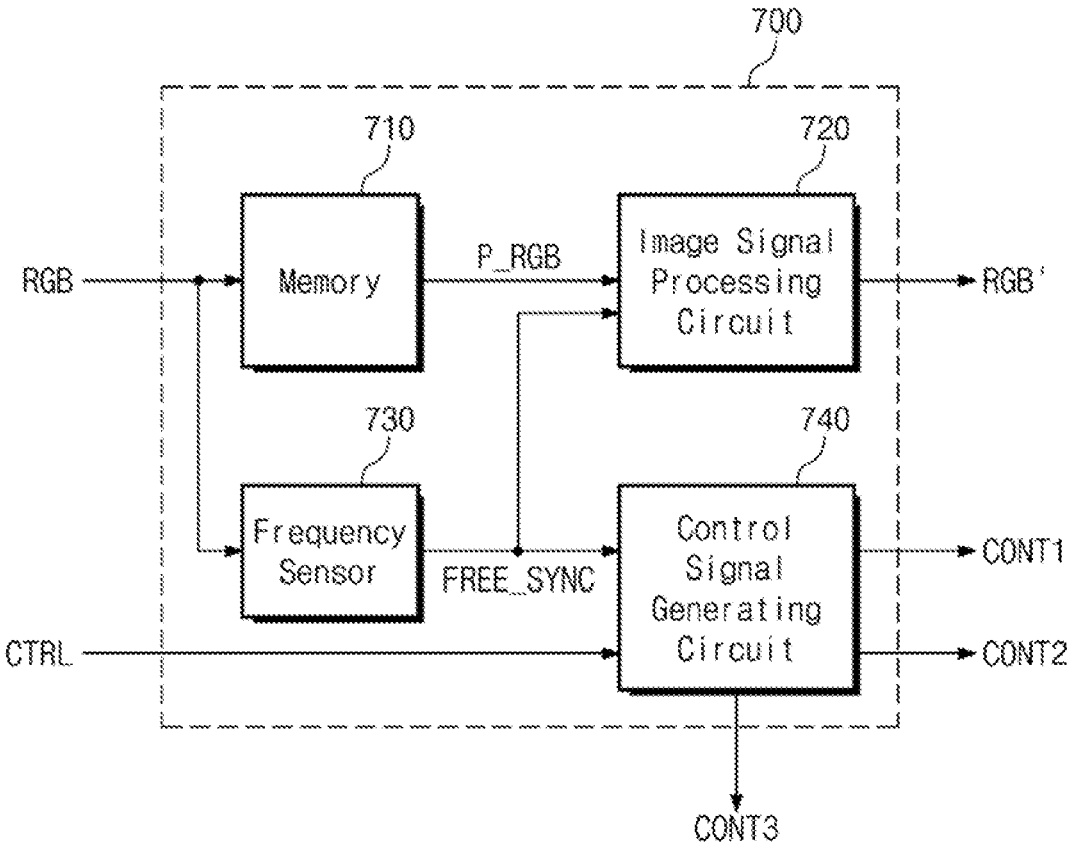
FIG. 19 is a block diagram showing a configuration of a driving controller according to another exemplary embodiment of the present disclosure.

FIG. 19 is a block diagram showing a configuration of a driving controller, 700, according to another exemplary embodiment of the present disclosure. Driving controller 700 includes a memory 710, an image signal processing circuit 720, a frequency sensor 730, and a control signal generating circuit 740.

The memory 710 stores the first image signals RGB and outputs previous image signals P_RGB of a previous frame. The frequency sensor 730 outputs the variable frequency signal FREE_SYNC based on frequency information included in the first image signals RGB.

Figure 20:
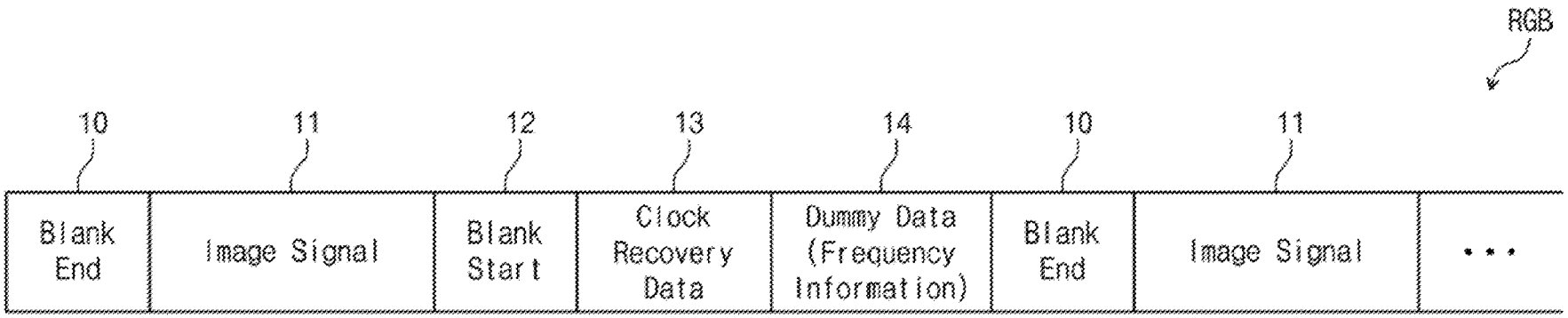
FIG. 20 illustrates an example frame structure for first image signals applied to a display device according to another exemplary embodiment of the present disclosure.

FIG. 20 illustrates an example frame structure for the first image signals RGB applied to a display device according to another exemplary embodiment of the present disclosure. Here, the first image signals RGB include a blank end display section 10, an image signal section 11, a blank start display section 12, a clock recovery data section 13, and a dummy data section 14. In this example, frequency information corresponding to the first image signals RGB may be included in the dummy data section 14.

Returning to FIG. 19, the frequency sensor 730 outputs the variable frequency signal FREE_SYNC based on the frequency information included in the dummy data section 14 of the first image signals RGB.

Since the frequency information of the present frame is included in a field of the first image signals RGB frame structure of the present frame, the compensation value with respect to the first image signal RGB may be calculated after all the first image signals RGB of one frame are received. Accordingly, the memory 710 may be required to store the first image signals RGB corresponding to at least one frame.

The image signal processing circuit 720 converts the previous image signals P_RGB to the second image signals RGB' in response to the variable frequency signal FREE_SYNC. The image signal processing circuit 720 may output the second image signals RGB' obtained by adding the compensation value to the previous image signal P_RGB using a method similar to that of the image signal processing circuits shown in FIGS. 4 to 13.

The control signal generating circuit 740 outputs the first control signal CONT1 and the second control signal CONT2 based on the control signals CTRL. In addition, the control signal generating circuit 740 outputs the voltage control signal CONT3 in response to the variable frequency signal FREE_SYNC to set the voltage level of the first, second, third, and fourth driving voltages VGMA_UH, VGMA_UL, VGMA_LH, and VGMA_LL generated by the voltage generator 130 shown in FIG. 1.

Figure 21:
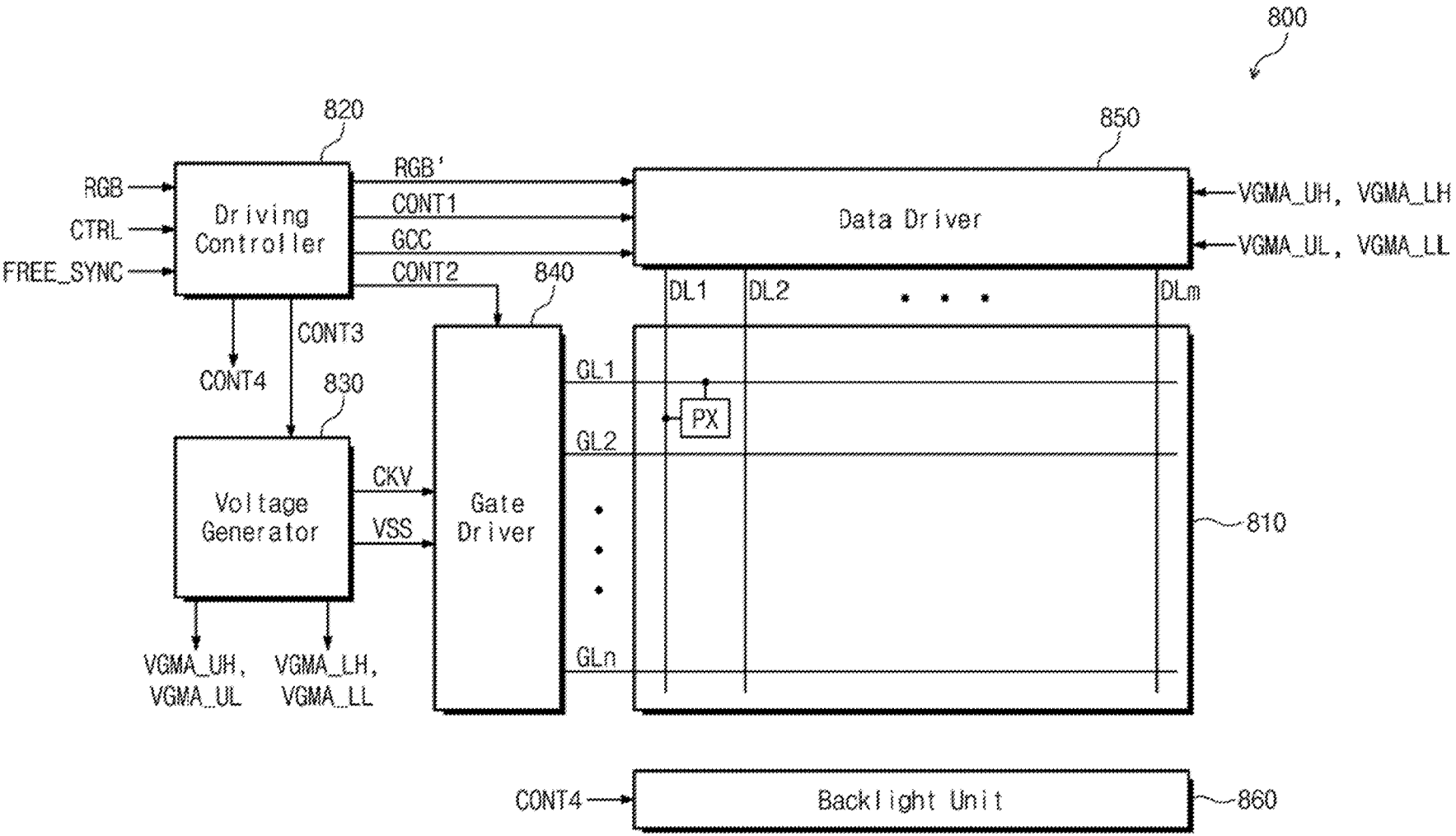
FIG. 21 is a block diagram showing a configuration of a display device according to another exemplary embodiment of the present disclosure.

FIG. 21 is a block diagram showing a configuration of a display device, 800, according to another exemplary embodiment of the present disclosure. Display device 800 includes a display panel 810, a driving controller 820, a voltage generator 830, a gate driver 840, a data driver 850, and a backlight unit 860.

The display device 800 shown in FIG. 21 further includes the backlight unit 860 as compared with the display device 100 shown in FIG. 1. While backlight unit 860 is shown schematically beneath a lower edge of the display panel 860, in practice it may underlay display panel 810 in a conventional manner for backlit displays such as LCD displays. Backlight unit 860 provides light to display panel 810 and the pixels PX individually adjust the transmission of the light to generate an overall image in the display panel 810.

The configurations and operations of the driving controller 820, the voltage generator 830, the gate driver 840, and the data driver 850, which are included in the display device 800, are substantially similar to those of the driving controller 120, the voltage generator 130, the gate driver 140, and the data driver 150 of the display device 100 shown in FIG. 1, respectively, and thus redundant description thereof will be omitted. However, driving controller 820 differs from driving controller 120 by being configured to generate and provides a backlight control signal CONT4 to the backlight unit 860, in response to the control signals CTRL and the variable frequency signal FREE_SYNC. The backlight unit 860 controls the luminance level of the light it provides to display panel 810 in response to the backlight control signal CONT4, where the luminance level may vary with the operating frequency indicated by the FREE_SYNC signal. By varying the luminance level in this manner, the luminance decrease caused by the blank period as described above may be compensated.

Figure 22:
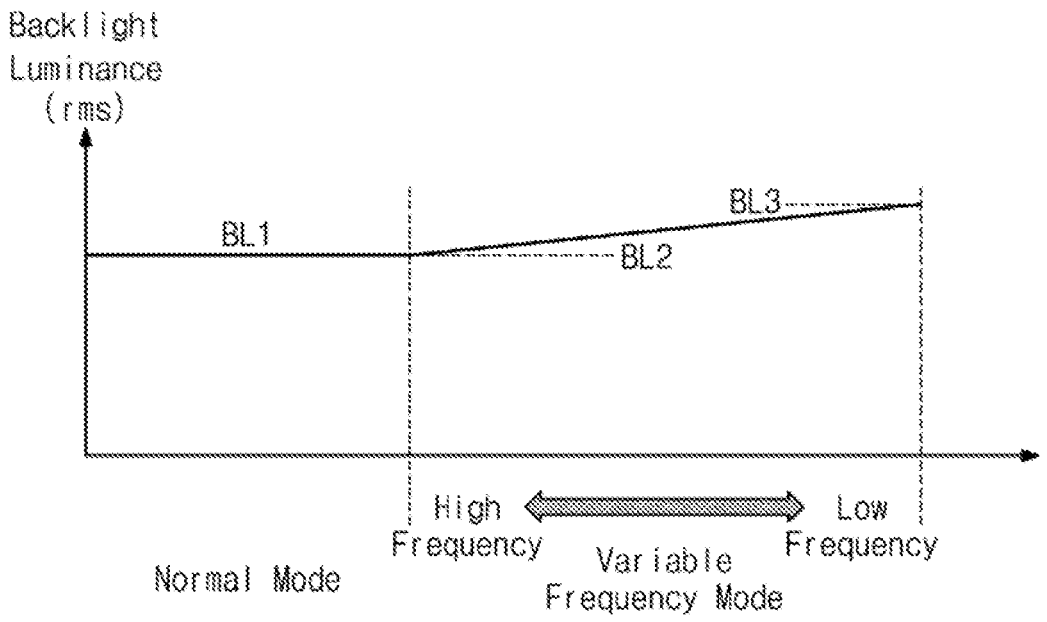
FIG. 22 is a graph showing a variation in backlight luminance as a function of an operating mode.

FIG. 22 is a graph showing a variation in backlight luminance as a function of an operating mode. As shown in FIG. 22, the luminance of the backlight unit 860 maintains a predetermined level BL1 in the normal mode in which the operation frequency is fixed. A light emitting luminance of the backlight unit 860 is changed according to the control signal CONT4 based on the variable frequency signal FREE_SYNC during the variable frequency mode in which the operation frequency is changed every frame. For instance, the light emitting luminance level BL3 of the backlight unit 860 at the low operation frequency (e.g., about 48 Hz) is higher than the light emitting luminance level BL2 of the backlight unit 860 at the high operation frequency (e.g., about 144 Hz).

According to the present exemplary embodiment, the decrease of the luminance, which is caused by the blank period that becomes longer at the low operation frequency (e.g., about 48 Hz), may be compensated by changing the light emitting luminance of the backlight unit 860.

In one embodiment, the decrease of the luminance caused by the blank period may be compensated by such variation of the luminance of the backlight unit 860 with the operating frequency as just described, without the driving controller 820 changing the grayscale values of the first image signals RGB to different values in the second image signals RGB'. That is, in this case, no compensation value is added to the first image signals RGB, whereby the second image signals RGB' may be substantially the same signals as the first image signals RGB. In an alternative embodiment, luminance may be compensated by a combination of: (i) varying the backlight unit 860 luminance with operation frequency as just described, and (ii) adding a compensation value to the first image signals RGB as a function of operation frequency to generate the second image signals RGB' having different grayscale values.

Figure 23:
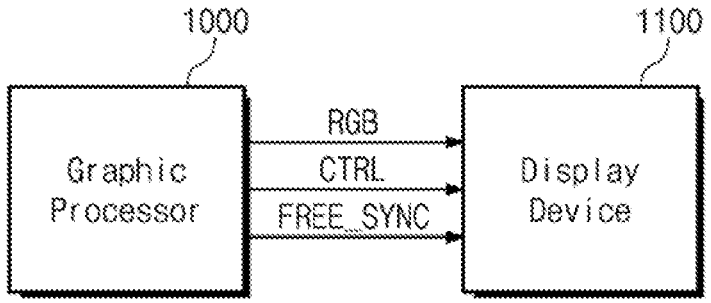
FIG. 23 is a block diagram showing an image display system according to another exemplary embodiment of the present disclosure.

FIG. 23 is a block diagram showing an image display system according to another exemplary embodiment of the present disclosure. The image display system of FIG. 23 includes a graphic processor 1000 and a display device 1100. The graphic processor 1000 provides the first image signals RGB, the control signals CTRL, and the variable frequency signal FREE_SYNC to the display device 1100.

The variable frequency signal FREE_SYNC may be a signal that indicates the operation frequency of the display device 1100, which is provided to the display device 1100 from the graphic processor 1000. According to another embodiment, the variable frequency signal FREE_SYNC may be a signal indicating that the operation frequency of the first image signals RGB is changed every frame.

The operation frequency of the display device 1100 may be changed depending on a rendering speed of the graphic processor 1000. The display device 1100 may be the display device 100 shown in FIG. 1 or the display device 800 shown in FIG. 18.

In the above-described embodiments, various elements may be embodied as hardware circuitry, which may include at least one processor and memory. If a processor is included, the processor may read instructions from the memory to execute a routine for executing one or more of the above-described operations. For example, driving controller 120, data driver 150, gate driver 140, voltage generator 130, adder 340, compensation value calculator 342, any of the first to fourth decoders, control signal generator 410, voltage controller 420, latch unit 520 and frequency sensor 730 may each be comprised of hardware circuitry and therefore may be alternatively called, respectively, a driving controller circuit, a data driver circuit, a gate driver circuit, a voltage generator circuit, an adder circuit, a compensation value calculator circuit, a decoder circuit, a control signal generator circuit, a voltage controller circuit, a latch circuit, and a frequency sensor circuit.

Although exemplary embodiments of the present inventive concept have been described, it is understood that the present inventive concept should not be limited to these exemplary embodiments but various changes and modifications can be made by one ordinary skilled in the art within the spirit and scope of the present inventive concept as hereinafter claimed. Therefore, the scope of the inventive concept should not be limited to the embodiments described herein, but should be determined according to the appended claims and their equivalents.

What is claimed is:

1. A display device comprising:

a display panel comprising a plurality of gate lines, a plurality of data lines, and a plurality of pixels individually connected to a corresponding gate line among the gate lines and a corresponding data line among the data lines;

a gate driver configured to drive the gate lines;

a data driver configured to drive the data lines; and a driving controller configured to:

receive, from an external source, first image signals, a control signal, and a variable frequency signal indicating an operation frequency;

control the gate driver based on the control signal;

convert the first image signals to second image signals by adding a compensation value corresponding to the operation frequency to the first image signals; and output the second image signals to the data driver.

2. The display device of claim 1, wherein, when the operation frequency indicated by the variable frequency signal is lower than a reference frequency, the compensation value has a first value, and when the operation frequency indicated by the variable frequency signal is equal to or greater than the reference frequency, the compensation value has a second value different from the first value.

3. The display device of claim 1, wherein the driving controller comprises an image signal processing circuit configured to convert the first image signals to the second image signals.

4. The display device of claim 3, wherein the image signal processing circuit comprises a dithering circuit configured to dither the first image signals based on the compensation value in response to the variable frequency signal and output the second image signals.

5. The display device of claim 4, wherein the dithering circuit comprises a plurality of dithering maps each having a size of "a" by "b", each of said "a" and "b" being is a positive integer, wherein the dithering circuit dithers the first image signals using the dithering maps, and outputs the first image signals.

6. The display device of claim 3, wherein the image signal processing circuit comprises:

a plurality of lookup tables, each storing a different set of compensation values; and a gamma correction circuit configured to convert the first image signals to the second image signals with reference to a lookup table corresponding to the variable frequency signal among the lookup tables.

7. The display device of claim 3, wherein the image signal processing circuit comprises:

a plurality of lookup tables, each storing a different set of dithering maps; and a dithering circuit configured to dither the first image signals with reference to a lookup table corresponding to the variable frequency signal among the lookup tables to output the second image signals.

8. The display device of claim 3, wherein the image signal processing circuit comprises:

a compensation value calculator circuit configured to calculate a first compensation value corresponding to the variable frequency signal;

a buffer configured to delay the first compensation value for one frame to output a second compensation value; and an adder circuit configured to add the second compensation value corresponding to a previous frame to the first image signals of a present frame to output the second image signals, and the compensation value is the second compensation value.

9. The display device of claim 8, wherein the second compensation value has a first value when the variable frequency signal corresponding to the previous frame indicates a first frequency range, and the second compensation value has a second value different from the first value when the variable frequency signal corresponding to the previous frame indicates a second frequency range higher than the first reference range.

10. The display device of claim 9, wherein the first value is smaller than the second value, and the first value is a negative number.

11. The display device of claim 1, further comprising a voltage generator configured to generate first and second driving voltages, wherein the driving controller further outputs a voltage control signal in response to the variable frequency signal to change a voltage level of the first and second driving voltages.

12. The display device of claim 11, wherein the driving controller comprises:

a control signal generator configured to generate a first control signal to control the data driver and a second control signal to control the gate driver; and a voltage controller configured to generate the voltage control signal in response to the variable frequency signal.

13. The display device of claim 12, wherein the voltage controller generates the voltage control signal to increase the voltage level of the first driving voltage to a predetermined level when the operation frequency indicated by the variable frequency signal is lower than a reference frequency.

14. The display device of claim 12, wherein the control signal generating circuit generates the voltage control signal to allow the first driving voltage to have a first level when the operation frequency indicated by the variable frequency signal is equal to or greater than a reference frequency, and the control signal generating circuit generates the voltage control signal to allow the first driving voltage to have a second level higher than the first level when the operation frequency indicated by the variable frequency signal is equal to or lower than a reference frequency.

15. The display device of claim 13, wherein the data driver comprises:

a resistor string which generates a plurality of gamma voltages between the first driving voltage and the second driving voltage;

a lookup table which outputs one gamma selection signal among a plurality of gamma selection signals in response to a reference gamma selection signal;

a first decoder which selects some gamma voltages of the gamma voltages in response to the gamma selection signal output from the lookup table and outputting the selected gamma voltages as plural gamma reference voltages; and a second decoder which converts the second image signals to grayscale voltages with reference to the gamma reference voltages, and the grayscale voltages are applied to the data lines.

16. The display device of claim 15, wherein the driving controller outputs the reference gamma selection signal corresponding to the variable frequency signal.

17. The display device of claim 1, wherein the variable frequency signal is included in a dummy data section of the first image signals and applied to the driving controller.

18. The display device of claim 17, wherein the driving controller comprises:

a memory operable to store the first image signals and output previous frame image signals;

a frequency sensor configured to output a frequency sensing signal based on the variable frequency signal included in the first image signal; and an image signal processing circuit configured to output the second image signals obtained by adding a compensation value corresponding to the frequency sensing signal to the previous frame image signals.

19. A display device comprising:

a display panel comprising a plurality of gate lines, a plurality of data lines, and a plurality of pixels each connected to a corresponding gate line among the gate lines and a corresponding data line among the data lines;

a gate driver configured to drive the gate lines;

a data driver configured to drive the data lines;

a backlight unit configured to provide a backlight to the display panel in response to a backlight control signal; and a driving controller configured to output second image signals to the data driver derived from first image signals received thereby, control the gate driver, and output the backlight control signal to control a luminance level of the backlight output by the backlight unit as a function of an operation frequency indicated by a variable frequency signal received from an external source.

20. The display device of claim 19, wherein the driving controller outputs the backlight control signal to control the backlight unit to provide the backlight having a first luminance when an operation frequency indicated by the variable frequency signal is higher than a reference frequency, and the driving controller outputs the backlight control signal to control the backlight unit to provide the backlight having a second luminance higher than the first luminance when the operation frequency indicated by the variable frequency signal is lower than a reference frequency.

* * * * *